US011080967B2

(12) United States Patent
Higgins et al.

(10) Patent No.: US 11,080,967 B2
(45) Date of Patent: Aug. 3, 2021

(54) BACK-BETTING USING A MOBILE DEVICE OR OTHER COMPUTING DEVICE

(71) Applicant: IGT, Las Vegas, NV (US)

(72) Inventors: Kevin Higgins, Reno, NV (US); Dwayne Nelson, Las Vegas, NV (US); Jeffery Shepherd, Reno, NV (US); David Froy, Lakeville-Westmorland (CA)

(73) Assignee: IGT, Las Vegas, NV (US)

( * ) Notice: Subject to any disclaimer, the term of this patent is extended or adjusted under 35 U.S.C. 154(b) by 101 days.

(21) Appl. No.: 16/216,111

(22) Filed: Dec. 11, 2018

(65) Prior Publication Data

US 2020/0184776 A1 Jun. 11, 2020

(51) Int. Cl.
*G07F 17/32* (2006.01)

(52) U.S. Cl.
CPC ..... *G07F 17/3288* (2013.01); *G07F 17/3223* (2013.01); *G07F 17/3227* (2013.01)

(58) Field of Classification Search
CPC .... G07F 17/32; G07F 17/3288; G07F 17/326; G07F 17/3262; G07F 17/3218; G07F 17/3204; G07F 17/3272
USPC ..... 463/20, 25, 29
See application file for complete search history.

(56) References Cited

U.S. PATENT DOCUMENTS 4,856,787 A * 8/1989 Itkis ..... G07F 17/32 273/237
6,652,378 B2 * 11/2003 Cannon ..... G07F 17/32 463/20
7,963,847 B2 * 6/2011 Baerlocher ..... G07F 17/32 463/16
7,980,948 B2 * 7/2011 Rowe ..... G07F 17/3288 463/20
8,021,230 B2 * 9/2011 Baerlocher ..... G07F 17/32 463/16
8,235,791 B2 * 8/2012 Kelly ..... G07F 17/32 463/20
8,241,106 B2 * 8/2012 Kelly ..... G07F 17/3274 463/20
8,251,791 B2 * 8/2012 Baerlocher ..... G07F 17/32 463/16

(Continued)

*Primary Examiner* — Michael A Cuff
(74) *Attorney, Agent, or Firm* — Sheridan Ross P.C.

(57) ABSTRACT

The present disclosure relates generally to gaming systems and, in particular, to back-betting within a gaming system. As an example, a back-betting system is disclosed to include a first communication interface that facilitates machine-to-machine communications with an Electronic Gaming Machine (EGM) of a gaming system, where the first communication interface is used to exchange state-of-play information with the EGM. The system is also disclosed to include a second communication interface that facilitates machine-to-machine communications with a mobile device, where the second communication interface is used to exchange back-bet wager information and deliver an indication of an outcome of a back-bet placed during a back-betting session established with the mobile device. The system may still further include a processor and a computer-readable storage medium with processor-executable instructions that limit a duration of the back-betting session based on an association existing between the EGM and the mobile device.

8 Claims, 19 Drawing Sheets

(56) References Cited

U.S. PATENT DOCUMENTS

| | | | | |
|---|---|---|---|---|
| 8,900,057 | B2 * | 12/2014 | Johnson | G07F 17/3227 463/29 |
| 8,905,831 | B2 * | 12/2014 | Lafky | G07F 17/3211 463/16 |
| 9,336,650 | B2 * | 5/2016 | Naylor | G07F 17/3244 |
| 9,595,159 | B2 * | 3/2017 | Chun | G07F 17/322 |
| 9,811,236 | B2 * | 11/2017 | Hilbert | G07F 17/3262 |
| 10,171,262 | B2 * | 1/2019 | Krammer | G05B 15/02 |
| 10,643,427 | B2 * | 5/2020 | Arnone | G07F 17/3244 |
| 10,818,137 | B1 * | 10/2020 | Danielson | G07F 17/3244 |
| 2011/0263318 | A1 * | 10/2011 | Agarwal | G07F 17/32 463/25 |
| 2012/0315984 | A1 * | 12/2012 | Carrico | G07F 17/3255 463/30 |
| 2015/0102105 | A1 * | 4/2015 | Perret | G06K 19/06046 235/440 |
| 2016/0109942 | A1 * | 4/2016 | Lyons | G06K 9/00 345/156 |
| 2018/0137317 | A1 * | 5/2018 | Lee | G06K 7/1413 |
| 2019/0197819 | A1 * | 6/2019 | Caputo | G06F 3/012 |
| 2020/0118381 | A1 * | 4/2020 | Nelson | G07F 17/3216 |
| 2020/0184777 | A1 * | 6/2020 | Higgins | G07F 17/3223 |

* cited by examiner

BACK-BETTING USING A MOBILE DEVICE OR OTHER COMPUTING DEVICE

BACKGROUND

The present disclosure relates to gaming systems and, in particular, back-betting using a mobile device or other computing device.

Very often electronic gaming machines (EGMs) become "hot" or players encounter a jackpot streak across a casino floor. When players hit such a "hot" EGM or win streak, the celebration generated by the EGM (sound, exciting graphical content, etc.), ends up gathering a significant amount of attention across the casino floor. Other players may gather around the "hot" EGM to see what's happening, partake in the excitement, congratulate the winning player, and cheer them on.

BRIEF SUMMARY

In certain embodiments, the present disclosure relates to a back-betting system, method, and user computational device. In some embodiments, a method of facilitating back-betting in a gaming system is provided that includes: associating a user computational device with an asset of the gaming system; utilizing the association between the user computational device and the asset of the gaming system to establish a back-betting session between the user computational device and a back-betting system; exchanging back-bet wager information via the back-betting session; delivering an indication of an outcome of a back-bet placed over the back-betting session, where the outcome of the back-bet relates to an outcome of an event that occurred at the asset of the gaming system; and concluding the back-betting session such that no more back-bets are allowed to be placed via the user computational device with respect to the asset of the gaming system unless another back-betting session is established.

In some embodiments, a user computational device is provided that includes: a communication interface that facilitates machine-to-machine communications; a user interface comprising a user input and user output; a processor coupled with the communication and user interfaces; and a computer-readable storage medium, coupled with the processor, having instructions that are executable by the processor, where the instructions include: an association instruction set that enables the user computational device to be associated with and dissociated from an asset of a gaming system; and a back-betting instruction set that enables the establishment of a back-betting session between the user computational device and a back-betting system when the user computational device is associated with the asset of the gaming system, where the back-betting instruction set further enables an exchange of back-bet wager information via the back-betting system and restricts the placement of back-bets with the back-betting system when the user computational device is not associated with the asset of the gaming system.

In some embodiments, a back-betting system is provided that includes: a first communication interface that facilitates machine-to-machine communications with an Electronic Gaming Machine (EGM) of a gaming system, where the first communication interface is used to exchange state-of-play information with the EGM; a second communication interface that facilitates machine-to-machine communications with a mobile device, where the second communication interface is used to exchange back-bet wager information and deliver an indication of an outcome of a back-bet placed during a back-betting session established with the mobile device; a processor; and a computer-readable storage medium with processor-executable instructions that limit a duration of the back-betting session based on an association existing between the EGM and the mobile device.

Additional features and advantages are described herein and will be apparent from the following Description and the figures.

DETAILED DESCRIPTION

Figure 1:
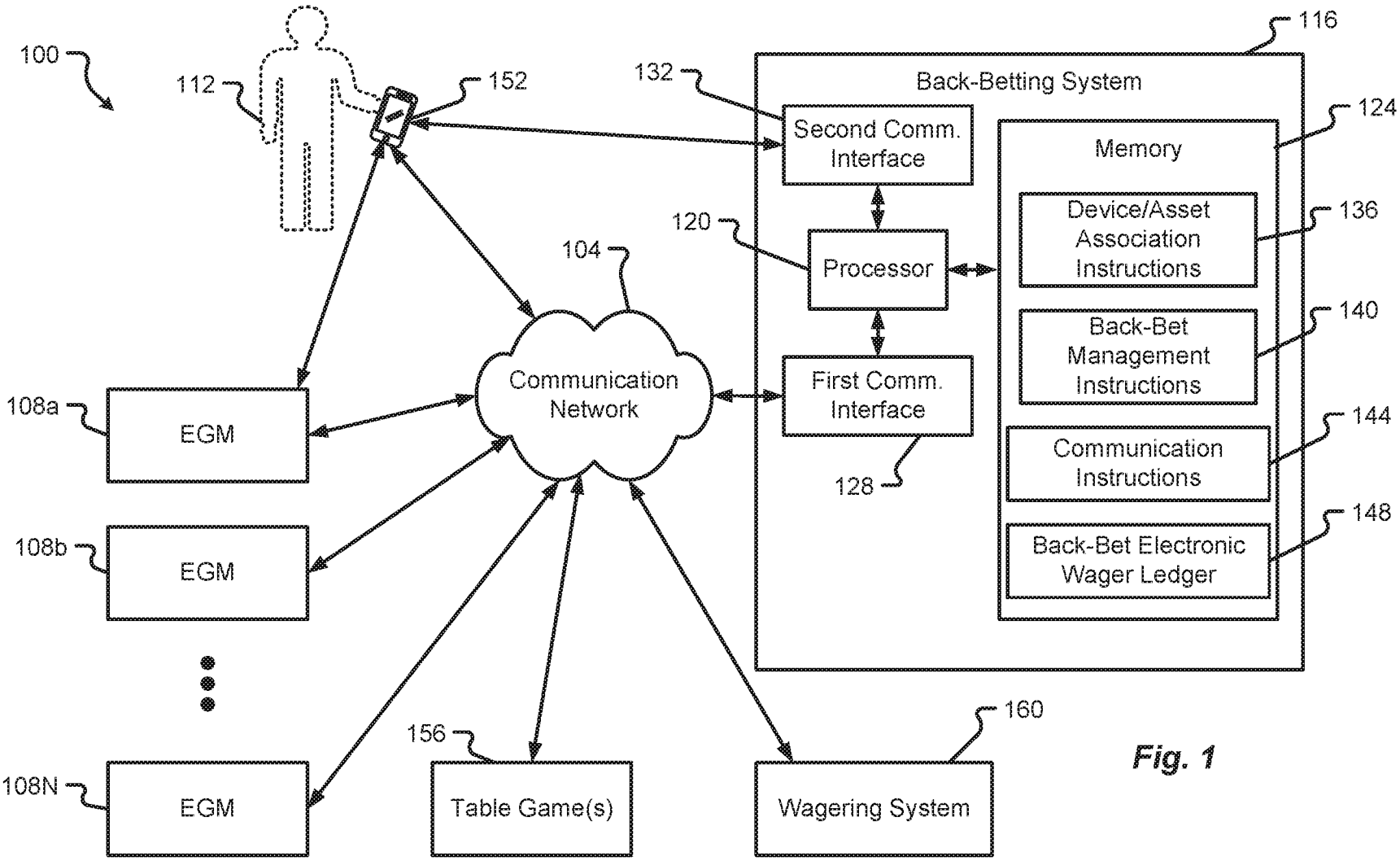
FIG. 1 is a block diagram of a gaming system accordance with embodiments of the present disclosure.

Embodiments of the present disclosure will be described in connection with a gaming system having one or multiple user devices that enable gaming activity. While certain embodiments of the present disclosure will reference the use of an EGM and mobile device as the pair of devices that enable back-betting, it should be appreciated that embodiments of the present disclosure are not so limited. For instance, any computing device, personal gaming device, or collection of computing devices interacting with one or many different casino assets such as table games, games of skill, etc. may be used to facilitate back-betting within a gaming system.

While it is a fun and exciting experience for those gathering around a winning player, today the other observers cannot partake in the risk/reward experience the player is experiencing. Embodiments of the present disclosure provide players in a crowd around a primary gambling player to partake in the gambling "ride" of the "hot" player or EGM through back-betting on their personal user computational device (e.g., mobile device). Back-betting is a concept in gaming where a first player (e.g., a primary gambling player) is playing a game of chance, meanwhile a second player (e.g., a back-betting player) is wagering on the outcome of first player's play. The casino may also benefit as there are a finite number of EGMs on the casino floor. Back-betting allows multiple players to take advantage of a single terminal, thereby providing the casino more wagering traffic than would be otherwise possible.

Back-betting at an EGM, such as a slot machine or poker machine, can be done in a variety of ways, although there are a few obstacles to address: (1) creating a back-betting session or establishing an association between the EGM and back-betting player's device; (2) managing placement of back-bets placed at the back-betting player's device; and (3) ending the back-betting session.

In some embodiments, the back-betting process is initiated by establishing an association between a back-betting player's device (e.g., a mobile device) and the EGM that they wish to back-bet on. An association can be achieved in a variety of ways including, without limitation: tapping a mobile device to a designated pairing region on the EGM, such as the card reader bezel, to create a wireless connection between the back-betting player's mobile device and the EGM; tapping a back-betting player's mobile device to a pairing region explicitly designated for back-betting, such as the back of the chair in front of an EGM; pairing at a distance, where the player selects the EGM, either from a list of EGMs within the player's proximity as determined by radio signal strength, or from a list of EGMs which are "hot" nearby or across the casino floor; pairing via an optical code, barcode, or QR code displayed on the machine; a primary gambling player may disallow back-betting on the EGM the player is playing; a primary gambling player may be given the option to allow a back-bet session or not; and only once the EGM association or pairing has completed can the back-betting player move on to the next step, which is to place back-bets.

The back-betting application can be run on a mobile device, a tablet, or any other computing platform. In some embodiments, the application can run on a mobile or personal computational device allowing for proximity pairing as described above. The application could run on a Personal Computer (PC)-like device or laptop-like device. Embodiments of the present disclosure contemplate an area in a casino dedicated to back-betting with a set of terminals dedicated to back-betting. Embodiments of the present disclosure also contemplate the back-betting player being able to wager from a personal device in his room or via the television or other casino-provided device in his room. In some embodiments, the application can run on any computing platform allowing the back-betting player to review the floor via a map or list of EGMs looking for machines of a certain criteria. In some embodiments, a back-betting player may search for a "hot" machine or machines that have not hit a jackpot in a long time. The back-betting player can then select that machine that meets their filter criteria and attempt to initiate a back-betting session with the selected machine.

There are two or more ways to place back-bets on an EGM. In some embodiments, the EGM itself could be responsible for receiving back-bets, recording the back-bets, and paying back-betting players in addition to paying primary gambling players. Alternatively or additionally, a back-betting system could interact with the EGM, collect back-bets, and pay players based upon the outcomes reported by an EGM.

In some embodiments, the EGM is the entity coordinating back-bets. In this architecture, when players pair or associate their mobile device with the EGM, the EGM is responsible for working with the back-betting player's mobile device to determine the amount of the back-bet per session, funding the back-bet with funds from the player, such as from the player's account in a cashless wagering system, and awarding winnings. In this architecture, the EGM may be configured to account for all transfers, wagers, and awards related to back-betting activity and may, therefore, create and report the following meters:

Transfers onto the EGM for back-bets

Transfers off the EGM associated with back-bets

Credit meter to hold funds associated with transfers onto the EGM, or wins associated with back-bets Meter for wagers associated with back-bets Meter for game awards associated with back-bets The above meters may be managed on a per-EGM basis or on a per back-better basis if multiple back-betting players are betting on a single EGM.

In some embodiments, the back-betting can be treated as an activity managed by a dedicated back-betting system or mobile gaming system, where the EGM determines the wagers and wins, and that data is then fed to the back-bet system to determine the amount to debit or credit to a given back-bet session. In some embodiments, the player's mobile device can pair with an EGM or slot machine interface board (SMIB), and coordinate wagers with the EGM or SMIB, which in turn communicates with the back-end back-betting system. Alternatively or additionally, the back-betting player's mobile device may communicate with the EGM/SMIB for pairing only, and communicate directly with the back-betting system for all other back-bet related information.

In yet another model, it may be possible to facilitate pairing or device association without requiring a direct interaction between the back-betting player's mobile device and the EGM/SMIB. Rather, the EGM may be selected by the back-betting player on their mobile device, possibly from a list published by the back-betting system, or from a list of EGMs within wireless range, and back-bets are coordinated directly between the mobile app on the player's mobile device and the back-betting system.

In an EGM today, a set of meters electronically stored in the EGM tracks all money in and out of the EGM. Accounting systems can read the meters from the EGMs and generate revenue and performance reports on the play at the EGM. This reporting includes tracking the progressive prizes and their values as it relates to the play tracked by the EGM meters. In this system coordinated back-betting model and in accordance with at least some embodiments, meters may not be used to track back-bets. Rather, a transaction model of accounting is conceived for the purposes of tracking play. In some embodiments, each wager placed by a back-betting player could be transmitted to the accounting system and an electronic ledger would record the wager. Included in the transaction would be, for example, the amount wagered and the amount won. At the end of the gaming day, the recorded transactions could be accumulated, and reports generated that tracked the back-betting play and the progressive prize values. In still other embodiments, the back-betting system could be configured to synthesize meters which simulated the meters generated by the EGM.

With reference initially to FIG. 1, details of an illustrative gaming system 100 will be described in accordance with at least some embodiments of the present disclosure. The components of the gaming system 100, while depicted as having particular instruction sets and devices, is not necessarily limited to the examples depicted herein. Rather, a system according to embodiments of the present disclosure may include one, some, or all of the components depicted in the system 100 and does not necessarily have to include all of the components in a single device. For instance, the components of a back-betting system may be contained within a single server or distributed amongst a plurality of servers and/or other devices (e.g., an EGM, user computational device, etc.) in the system 100 without departing from the scope of the present disclosure.

The gaming system 100 is shown to include a communication network 104 that interconnects and facilitates machine-to-machine communications between one or multiple gaming devices (e.g., EGMs) 108*a*-N, a wagering system 160, and a back-betting system 116. It should be appreciated that the communication network 104 may correspond to one or many communication networks without departing from the scope of the present disclosure. In some embodiments, the various EGMs 108*a*-N and systems(s)/server(s) 116, 160 may be configured to communicate using various nodes or components of the communication network 104. The communication network 104 may comprise any type of known communication medium or collection of communication media and may use any type of protocols to transport messages between endpoints. The communication network 104 may include wired and/or wireless communication technologies. The Internet is an example of the communication network 104 that constitutes an Internet Protocol (IP) network consisting of many computers, computing networks, and other communication devices located all over the world, which are connected through many telephone systems and other means. Other examples of the communication network 104 include, without limitation, a standard Plain Old Telephone System (POTS), an Integrated Services Digital Network (ISDN), the Public Switched Telephone Network (PSTN), a Local Area Network (LAN), a Wide Area Network (WAN), a cellular network, and any other type of packet-switched or circuit-switched network known in the art. In addition, it can be appreciated that the communication network 104 need not be limited to any one network type, and instead may be comprised of a number of different networks and/or network types. Moreover, the communication network 104 may comprise a number of different communication media such as coaxial cable, copper cable/wire, fiber-optic cable, antennas for transmitting/receiving wireless messages, and combinations thereof.

In some embodiments, the EGMs 108*a*-N may be distributed throughout a single property or premises (e.g., a single casino floor) or the EGMs 108*a*-N may be distributed among a plurality of different properties. In a situation where the EGMs 108*a*-N are distributed in a single property or premises, the communication network 104 may include at least some wired connections between network nodes. As a non-limiting example, the nodes of the communication network 104 may communicate with one another using any type of known or yet-to-be developed communication technology. Examples of such technologies include, without limitation, Ethernet, SCSI, PCIe, RS-232, RS-485, USB, ZigBee, WiFi, CDMA, GSM, HTTP, TCP/IP, UDP, etc.

The EGMs 108*a*-N may utilize the same or different types of communication protocols to connect with the communication network 104. It should also be appreciated that the EGMs 108*a*-N may or may not present the same type of game to a player 112. For instance, the first EGM 108*a* may correspond to a gaming machine that presents a slot game to the player 112, the second EGM 108*b* may correspond to a video poker machine, and other gaming devices may present other types of games or a plurality of different games for selection and eventual play by the player 112. It may be possible for some of the EGMs 108*a*-N to communicate with one another via the communication network 104. In some embodiments, one or more of the EGMs 108*a*-N may only be configured to communicate with a centralized management server in the form of a wagering system. The wagering system 160 may include components that manage wagers at the EGMs 108*a*-N, manage game play at the EGMs 108*a*-N, monitor player activity at the EGMs 108*a*-N, and/or perform any other task in connection with games played by a player at the EGMs 108*a*-N. It should also be appreciated that the wagering system 160 may be configured to manage game play at non-EGM assets such as table games 156 and other locations where players 112 are allowed to participate in a game of chance or wager on outcomes of those games of chance.

As will be discussed in further detail herein, a back-betting player 112 may be allowed to participate in a back-betting session with any type of asset within the gaming system 100, such as an EGM 108*a*-N, a table game 156, and the like. In some embodiments, a player 112 may be enabled to participate in a back-betting session for a particular asset using the player's computational device 152. The computational device 152 may correspond to a mobile communication device, such as a smartphone, tablet, laptop, PDA, wearable device, an augmented reality headset, a virtual reality headset, or the like. In other embodiments, the computational device 152 may correspond to a PC, kiosk, or the like that facilitates remote back-betting sessions for the player 112. In some embodiments, the computational device 152 may be configured to communicate directly with an EGM 108*a*-N (or table game 156). Direct communications may utilize a proximity-based communication protocol such as NFC, Bluetooth®, BLE, WiFi, or the like. Alternatively or additionally, the computational device 152 may be configured to communicate directly with the back-betting system 116. Alternatively or additionally, the computational device 152 may be configured to communicate with other devices in the system 100 via the communication network 104. Such communications may be secured (e.g., encrypted) or unsecured depending upon the nature of information exchanged during the communications. A mobile device may correspond to a player's 112 computational device 152 or to a device issued to the player 112 during the player's visit at a particular casino.

It should be appreciated that the server(s) implementing the back-betting system 116 may or may not be co-located with one or more EGMs 108*a*-N in the same property or premises. Thus, one or more EGMs 108*a*-N may communicate with the back-betting system 116 over a WAN, such as the Internet. In such an event, a tunneling protocol or Virtual Private Network (VPN) may be established over some of the communication network 104 to ensure that communications between an EGM and a remotely-located server are secured.

It should also be appreciated that the server(s) implementing the back-betting system 116 may or may not be co-located with the server(s) implementing the wagering system 160. Further still, it may be possible to provide the functionality of the back-betting system 116 and the wagering system 160 within a single server or server cluster.

The EGMs 108*a*-N may correspond to a type of device that enables player 112 interaction in connection with playing games of chance. An EGM 108*a*-N may include any type of known gaming device such as a slot machine, keno machine, an electronic table game (e.g., video poker), a skill-based game, etc. In addition to playing games of chance or skill on an EGM 108*a*-N, the player 112 may also be allowed to interact with and play games of chance or skill on their computational device 152. Thus, the player 112 may play games directly on their device 152 and/or the device 152 may be in communication with the back-betting system 116 to facilitate back-betting sessions for one or more EGMs.

The back-betting system 116 is shown to include a number of components that facilitate the establishment, management, and conclusion of back-betting sessions for a back-betting player 112. Although not depicted, the wagering system 160 may include similar components, such as a network interface, processor, and computer memory. Thus, the components depicted as being included in the back-betting system 116 may also be included in the wagering system 160 without departing from the scope of the present disclosure. The details of the wagering system 160 are not shown in FIG. 1 for purposes of clarity and ease of discussion and should not be construed as limiting embodiments described herein.

The gaming server 116 is shown to include a processor 120, memory 124, and a plurality of network interfaces 128, 132. These resources may enable functionality of the back-betting system 116 as will be described herein. For instance, the first network interface 128 provides the system 116 with the ability to send and receive communication packets or the like over the communication network 104. The first network interface 128 may be provided as a network interface card (NIC), a network port, drivers for the same, and the like. Communications between the components of the system 116 and other devices connected to the communication network 104 may all flow through the first network interface 128. The back-betting system 116 is also shown to include a second communication interface 132 that facilitates communications with a user computational device 152. In some embodiments, the second communication interface 132 may be similar to the first communication interface 128. For instance, the second communication interface 132 may also include a NIC, network port, drivers for the same, and the like. In some embodiments, the first and second communication interfaces 128, 132 may be provided in a single physical component or set of components, but may correspond to different communication channels (e.g., software-defined channels, frequency-defined channels, amplitude-defined channels, etc.) that are used to send/receive different communications to the EGMs 108*a*-N as compared to the computational device 152. In some embodiments, a single communication interface may facilitate communications with both the EGMs 108*a*-N and the computational device 152, especially if both devices communicate with the back-betting system 116 via the communication network 104.

It should also be appreciated that, while not depicted, a separate communication network may enable communications between the computational device 152 and back-betting system 116. The separation communication network may utilize cellular communication technologies, wireless communication technologies, or the like. Thus, the separate communication network may include a WLAN, cellular network, or the like. As will be discussed in further detail herein, the first interface 128 may be used to facilitate machine-to-machine communications with EGMs 108*a*-N and to exchange state-of-play information with the EGMs 108*a*-N. The second interface 132 may be used to facilitate machine-to-machine communications with the computational device 152 (e.g., a mobile device), to exchange back-bet wager information, and to deliver an indication of an outcome of a back-bet placed during a back-betting session established with the computational device 152.

The processor 120 may correspond to one or many computer processing devices. For instance, the processor 120 may be provided as silicon, as a Field Programmable Gate Array (FPGA), an Application-Specific Integrated Circuit (ASIC), any other type of Integrated Circuit (IC) chip, a collection of IC chips, or the like. As a more specific example, the processor 120 may be provided as a microcontroller, microprocessor, Central Processing Unit (CPU), or plurality of microprocessors that are configured to execute the instructions sets stored in memory 124. Upon executing the instruction sets stored in memory 124, the processor 120 enables various authentication functions of the back-betting system 116.

The memory 124 may include any type of computer memory device or collection of computer memory devices. The memory 124 may include volatile and/or non-volatile memory devices. Non-limiting examples of memory 124 include Random Access Memory (RAM), Read Only Memory (ROM), flash memory, Electronically-Erasable Programmable ROM (EEPROM), Dynamic RAM (DRAM), etc. The memory 124 may be configured to store the instruction sets depicted in addition to temporarily storing data for the processor 120 to execute various types of routines or functions.

The illustrative instruction sets that may be stored in memory 124 include, without limitation, a device/asset association instruction set 136, a back-bet management instruction set 140, a communication instruction set 144, and a back-bet electronic wager ledger 148. Functions of the back-betting system 116 enabled by these various instruction sets will be described in further detail herein. It should be appreciated that the instruction sets depicted in FIG. 1 may be combined (partially or completely) with other instruction sets or may be further separated into additional and different instruction sets, depending upon configuration preferences for the system 116. Said another way, the particular instruction sets depicted in FIG. 1 should not be construed as limiting embodiments described herein.

In some embodiments, the device/asset association instruction set 136, when executed by the processor 120, may enable the back-betting system 116 to help facilitate the establishment of an association between a computational device 152 and an asset within the gaming system 100. More specifically, the device/asset association instruction set 136 may be configured to enable an association between the computational device 152 and an EGM 108*a*-N that can be leveraged by the back-bet instruction set 140 for purposes of creating and maintaining a back-bet session for a back-betting player on their computational device 152. The device/asset association instruction set 136 may also be used to monitor an association between a computational device 152 and asset and determine when the association has been broken (e.g., the devices have unpaired from one another). In some embodiments, the device/asset association instruction set 136 may be configured to report the establishment and conclusion of associations or pairings between devices to other instruction sets stored in memory 124.

The back-bet management instruction set 140, when executed by the processor 120, may enable the back-betting system 116 to track a status of back-betting sessions, accept back-bet wagers over the back-betting sessions, manage back-bet wagers, pay out back-bet wagers, and perform any other function related to the general management of back-betting sessions. In some embodiments, the back-bet management instructions 140 may be configured to synchronize back-bet wagers with events that occur at the EGMs 108*a*-N, table games 156, and other assets in the system 100. For instance, the back-bet management instruction set 140 may be configured to determine whether and when back-bets for a particular asset are allowable or not and, if such back-bets are allowable, the amounts and circumstances associated with such back-bets. It should also be appreciated that the back-bet management instruction set 140 may be configured to manage a back-bet prize pool and the distribution of awards therefrom.

The communication instruction set 144, when executed by the processor 120, may enable the back-betting system 116 to communicate with the other devices in the system 100. For instance, the communication instruction set 144 may be configured to modulate/demodulate communications exchanged over the communication network 104, determine timings associated with such communications, determine addresses associated with such communications, etc. In some embodiments, the communication instruction set 144 may be configured to allocate communication ports of the system 116 for use as either the first or second communication interface 128, 132 as appropriate. The communication instruction set 144 may further be configured to generate messages in accordance with communication protocols used by the network 104 and to parse messages received via the network 104.

The back-bet electronic wager ledger 148 may correspond to an electronic record or plurality of electronic records maintained by the back-betting system 116 in connection with managing back-bets placed at computational devices 152. In some embodiments, the back-bet electronic wager ledger 148 may be used to store information related to back-bets placed during a back-betting session, amounts of back-bets, the timing associated with back-bets, results of back-bets, etc. In some embodiments, the back-bet electronic wager ledger 148 may be used to store back-bet amounts wagered and amounts won. Such amounts may be stored with a relationship to the back-betting player 112, the back-betting player's computational device 152, and/or the asset that was associated with the computational device 152 during the back-betting session. In some embodiments, the back-bet electronic wager ledger 148 may store information about the EGM(s) 108*a*-N and/or table game(s) 156 involved as well or associated with the back-betting session. The back-bet electronic wager ledger 148 may also be used to store unique identifiers assigned to back-betting sessions for purposes of reporting to various gaming authorities.

As discussed above, the wagering system 160 may also include a processor and memory. In some embodiments, the wagering system 160 may include a game management instruction set that, when executed by the processor of the wagering system 160, may enable the system 160 to manage the various games played by a primary gambling player 112 at the EGMs 108*a*-N, table game(s) 156, and/or computational device 152 carried by the player 112. In other words, any game played by the player 112 at one or more of the devices 108*a*-N, 152, 156 may be managed, partially or entirely, by execution of the game management instruction set. The game management instruction set may also be configured to track a status of game events (e.g., sporting events, bingo, keno, lottery, etc.) and whether a primary gambling player 112 has placed a wager on such events.

Figure 2A:
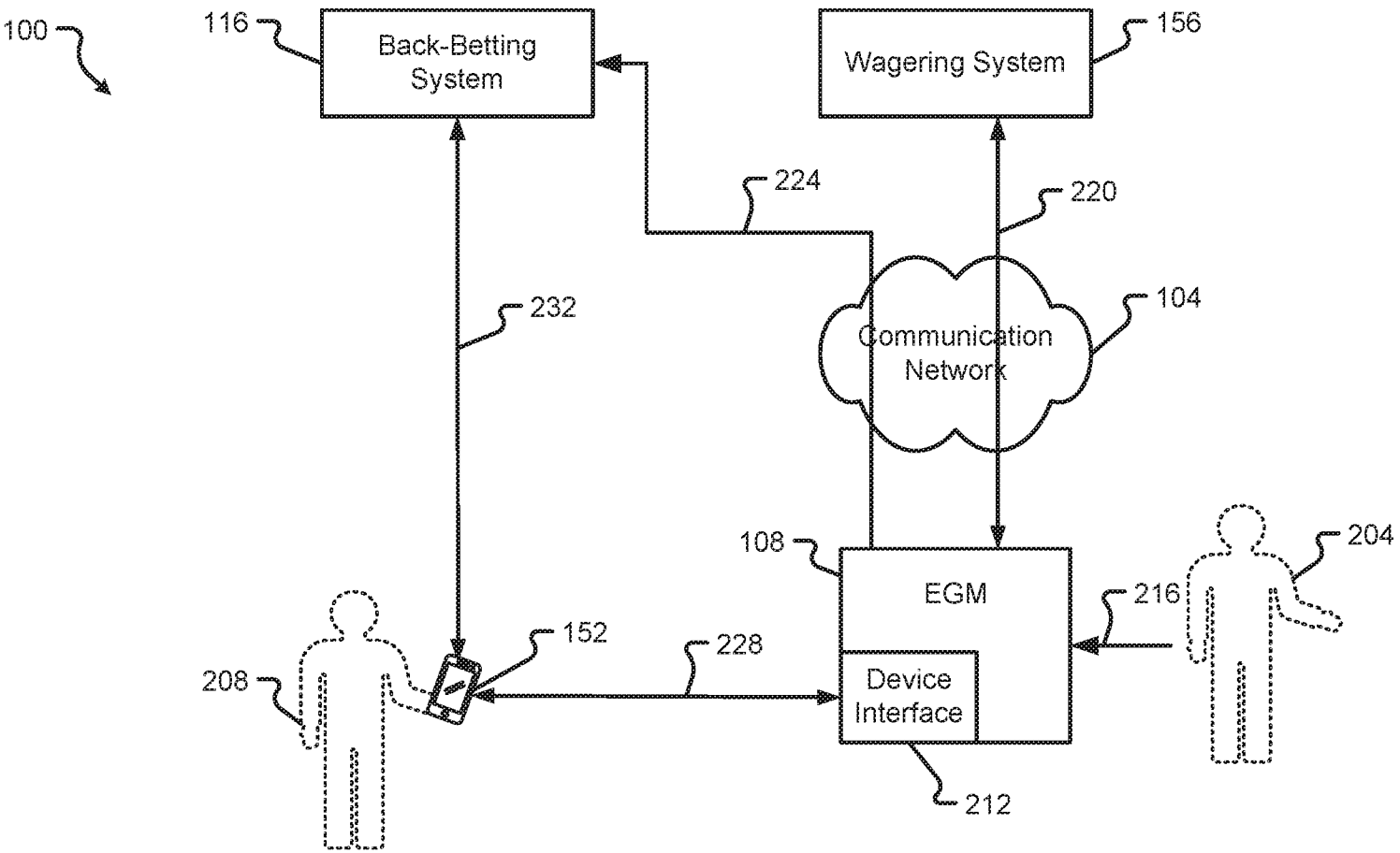
FIG. 2A is a block diagram depicting a first illustrative gaming system configuration in accordance with embodiments of the present disclosure.

With reference now to FIGS. 2A-2D, additional details and possible configurations of the system 100 will be described in accordance with at least some embodiments of the present disclosure. With reference initially to FIG. 2A, a first possible configuration of the system 100 will be described. In this particular configuration, back-betting sessions are managed by the back-betting system 116 either alone or in cooperation with the wagering system 156. In some embodiments, the EGM 108 may be configured to determine wagers and wins for a primary gambling player 204 in connection with a game played at the EGM 108. The EGM 108, in this configuration, may or may not also serve as a conduit for communications between the computational device 152 and the back-betting system 116. Specifically, in some embodiments, the computational device 152 may be configured to communicate directly with the back-betting system 116 such that communications concerning a back-betting session that includes the EGM 108 still bypass the EGM 108. However, in some embodiments, the computational device 152 may be configured to communicate at least some back-betting information with the back-betting system 116 through a device interface 212 of the EGM 108. In either situation, the back-betting system 116 may be configured to determine an amount to debit or credit to a particular back-betting session and/or player account for a back-betting player 208.

In some embodiments, the device interface 212 may include a wireless radio (e.g., Bluetooth interface, a BLE interface, an NFC interface, etc.). The device interface 212 may be in the form of an antenna embedded in the EGM 108 or as part of an SMIB. In some embodiments, the device interface 212 may be configured to establish and maintain the third communication pathway 228 with the computational device 152.

In the depicted embodiment, a first player 204 (e.g., a primary gambling player 204) is interfacing with the EGM 108 whereas a second player 208 (e.g., a back-betting player 208) is involved in a back-betting session that concerns the EGM 108 at which the first player 204 is playing. In some embodiments, the back-betting session may be facilitated by associating the computational device 152 with the EGM 108. This particular configuration exhibits a first communication pathway 220 between the EGM 108 and wagering system 156, a second communication pathway 224 between the EGM 108 and back-betting system 116, a third communication pathway 228 between the EGM 108 and computational device 152, and a fourth communication pathway 232 between the back-betting system 116 and computational device 152.

In some embodiments, the first communication pathway 220 may pass through the communication network 104 and be used to exchange game play information between the wagering system 156 and EGM 108. More specifically, the primary gambling player 204 may be allowed to interface 216 with the EGM 108 and place bets thereon in connection with a game of chance, game of skill, or the like. Outcomes for the game(s) played by the primary gambling player 204 may be communicated between the EGM 108 and wagering system 156. In some embodiments, the wagering system 156 may be used to manage a cashless wagering account for the primary gambling player 204. Thus, wager information, win information, state-of-play information, and the like for the game of chance or skill may be exchanged over the first communication pathway 220.

In some embodiments, the second communication pathway 224 may also pass through the communication network 104. The second communication pathway 224 may be used to carry back-bet information from the EGM 108 to the back-betting system 116. The back-bet information communicated over the second communication pathway 224 may include, without limitation, wager information for wagers placed by the primary gambling player 204, win information for wins achieved by the primary gambling player 204, and, optionally, back-bet information for a back-bet session involving the EGM 108 and computational device 152. State-of-play information and/or outcomes for games played by the primary gambling player 204 may be communicated to the back-betting system 116 via the second communication pathway 224.

The third communication pathway 228 may correspond to a wireless communication link established directly between the computational device 152 and EGM 108. Thus, establishment and maintenance of the third communication pathway 228 may require the computational device 152 to be within a predetermined distance of the EGM 108 (e.g., a wireless communication range). In some embodiments, the existence of the third communication pathway 228 may be required as part of determining an association exists between the EGM 108 and computational device 152. For instance, an association for back-betting purposes may require that the EGM 108 be paired with the computational device 152 vis-à-vis the third communication pathway 228. A failure to establish or maintain the third communication pathway 228 may result in a disassociation of the computational device 152 with the EGM 108, thereby resulting in a discontinuation of a back-betting session for the computational device 152 with respect to the EGM 108. The third communication pathway 228 may, in some embodiments, be used to carry back-bet information between the computational device 152 and EGM 108. Likewise, state-of-play information for a game played at the EGM 108 may be communicated to the computational device 152 via the third communication pathway 228.

The fourth communication pathway 232 may correspond to a direct pathway between the computational device 152 and back-betting system 116. In some embodiments, the fourth communication pathway 232 may bypass the EGM 108 and may or may not also bypass the communication network 104. In some embodiments, the fourth communication pathway 232 may traverse a communication network other than the communication network 104 that is provided between the EGM 108 and systems 116, 156. The fourth communication pathway 232 may be used to communicate back-bet information directly from the computational device 152 to the back-betting system 116. In situations where the fourth communication pathway 232 is used, the EGM 108 may still communicate state-of-play information to the back-betting system 116 via the second communication pathway 224. In this situation, the back-betting system 116 may be configured to correlate state-of-play information received over pathway 224 with back-bet wager information received over pathway 232. Likewise, results of back-bets may be communicated from the system 116 back to the computational device 152 and EGM 108 and such communications may be synchronized to the extent that the primary gambling player 204 is being informed of back-bet activity by the back-betting player 208 on the computational device 152. Thus, although pathway 224 is depicted as being unidirectional, it should be appreciated that the pathway 224 may be bidirectional without departing from the scope of the present disclosure.

Figure 2B:
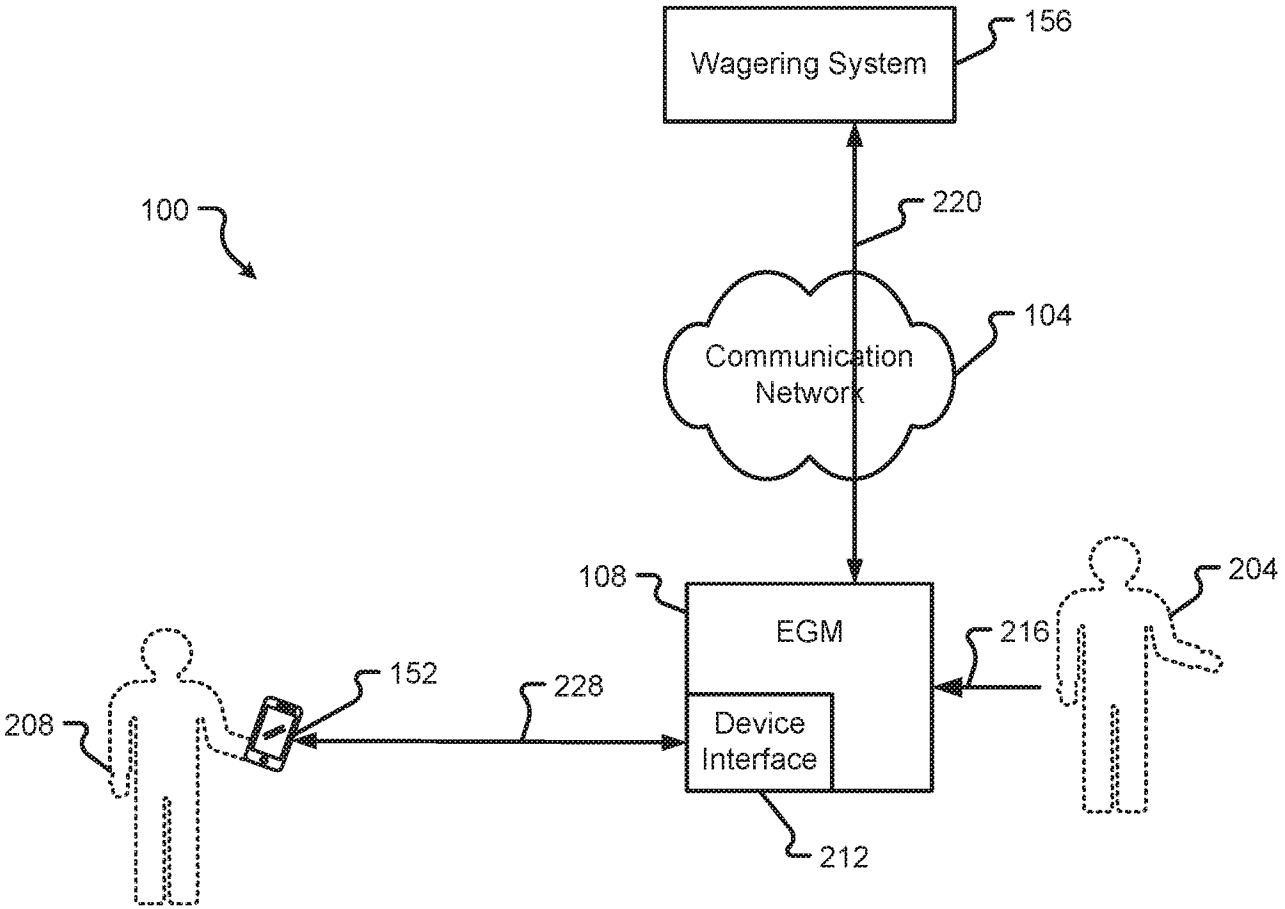
FIG. 2B is a block diagram depicting a second illustrative gaming system configuration in accordance with embodiments of the present disclosure.

With reference now to FIG. 2B, an alternative configuration of the system 100 will be described in accordance with at least some embodiments of the present disclosure. In this configuration, the EGM 108 may correspond to the entity coordinating back-bets made by the back-betting player 208 at the computational device 152. Thus, the EGM 108 may be provided with the functionality of the back-betting system 116 depicted in FIG. 1. Alternatively or additionally, some back-betting functionality may be contained in and provided by the wagering system 156. In some embodiments, when players 208 pair their computational device 152 with the EGM 108, the EGM 108 may become responsible for working with the back-betting player's 208 device 152 to determine the amount of the back-bet per session, funding the back-bet with funds from the player 208, such as from the player's cashless wagering system, and awarding winnings. In some embodiments, the EGM 108 may be configured to account for all transfers, wagers, and awards related to back-betting activity at the device 152 and may, therefore, be provided with one or more credit meters as will be discussed in further detail herein. In this configuration, all back-bet information placed by the back-betting player 208 at the computational device 152 may be communicated via the third communication pathway 228. Thus, this particular configuration may require a pairing between the devices 108, 152 as part of associating the devices and establishing the back-betting session for the back-betting player 208.

Figure 2C:
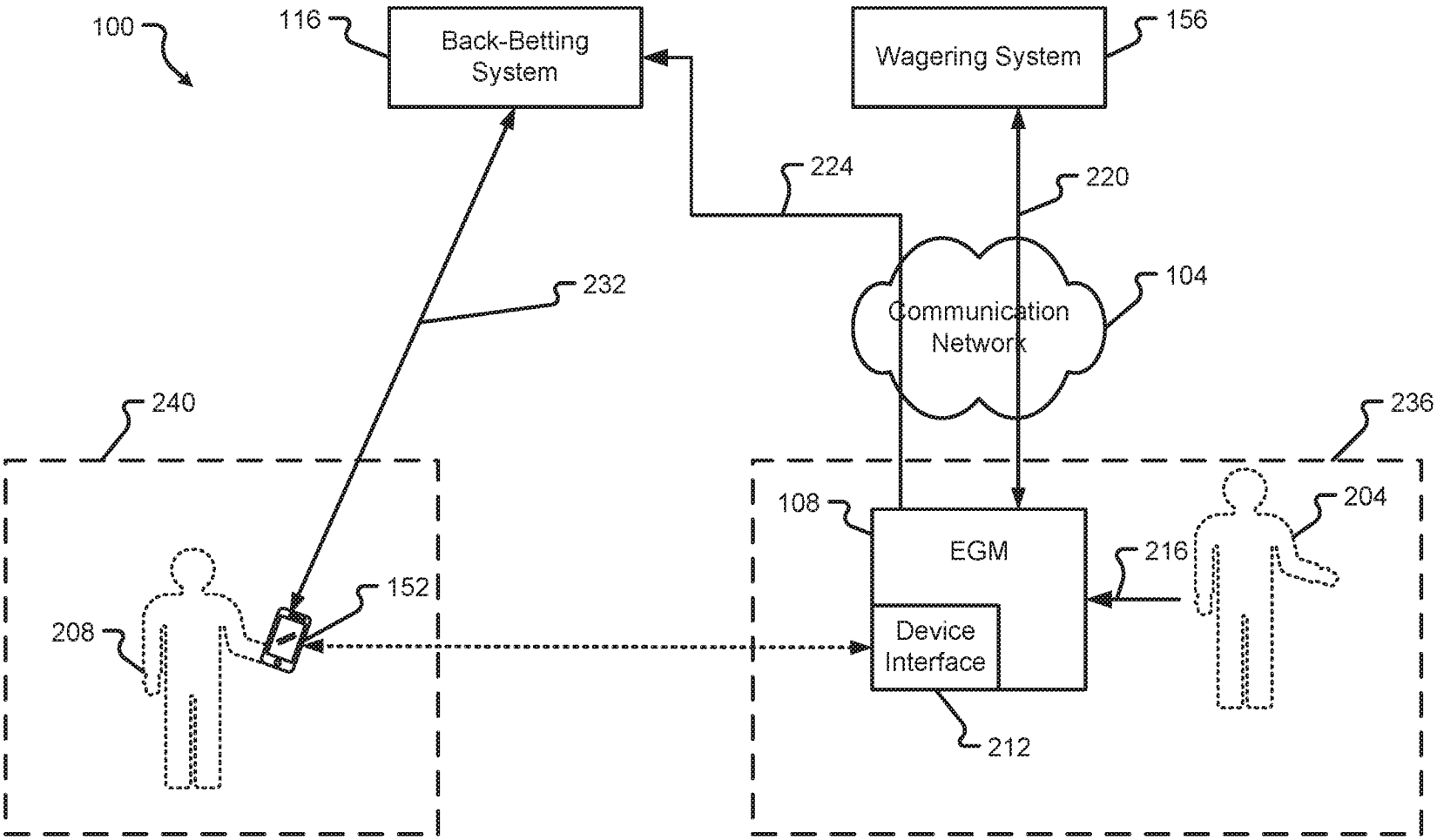
FIG. 2C is a block diagram depicting a third illustrative gaming system configuration in accordance with embodiments of the present disclosure.

With reference now to FIG. 2C, yet another configuration of the system 100 will be described in accordance with at least some embodiments of the present disclosure. The configuration depicted herein shows a back-betting player 208 being located at a location 240 or premises that is physically separated from a location 236 of the EGM 108. In some embodiments, the locations 236, 240 may be separated by more than a wireless communication range of the computational device 152 and/or EGM 108. Thus, this configuration may still enable an association between the devices 108, 152 for purposes of establishing the back-betting session, but the association may be based on something other than a direct pairing between the devices 108, 152. In some embodiments, state-of-play information may be communicated from the EGM 108 to the computational device 152 via the communication pathways 224, 232.

Thereafter, back-bet information may travel from the computational device 152 to the back-betting system 116. It should be appreciated that this particular configuration may have delays associated with game play at the EGM 108 as compared to back-bets placed at the computational device 152. Such delays may be created by having information traverse so many communication pathways and, possibly, travel relatively long distances. Accordingly, in some embodiments, this particular configuration may not be as well-suited for real-time back-betting at the computational device 152. Rather, the computational device 152 may be configured to engage in pre-commit back-bet wagers such that the back-betting player 208 is allowed to pre-authorize certain back-bets based on events that occur at the EGM 108 and/or wagers placed by the primary gambling player 204. Additional details of pre-commit back-bet wagers will be described in further detail herein.

Figure 2D:
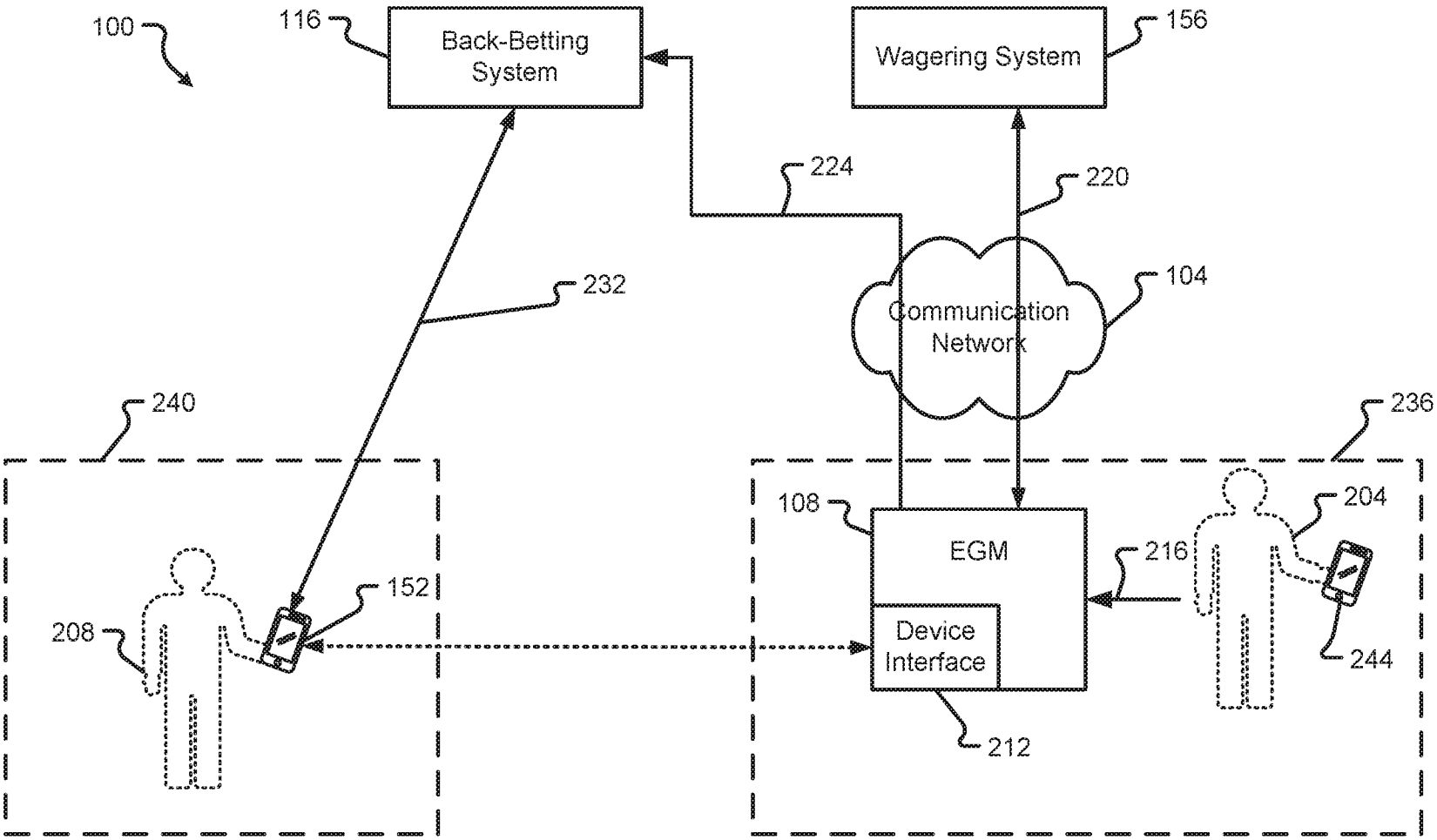
FIG. 2D is a block diagram depicting a fourth illustrative gaming system configuration in accordance with embodiments of the present disclosure.

With reference now to FIG. 2D, yet another configuration of the system 100 will be described in accordance with at least some embodiments of the present disclosure. The configuration depicted in FIG. 2D shows the player 204 with their own computational device 244, which may be similar to a computational device 152 carried by the back-betting player 208. In some embodiments, the computational device 244 carried by the primary gambling player 204 may be used to enable the primary gambling player 204 to stream or otherwise interact directly with one or more back-betting players 208. As a non-limiting example, the primary gambling player 204 may utilize the computational device 244 to stream their gameplay session at the EGM 108, to request back-bets from the various back-betting player 208, to request other inputs from the back-betting player 208, etc.

In some embodiments, the primary gambling player 204 may also be referred to as a streaming player in the event that the player 204 streams or otherwise shares details of their gameplay session at the EGM 108 with other back-betting players 208. The computational device 244 may be provided with an image capture device (e.g., a camera) and/or an audio capture device (e.g., a microphone) to enable the primary gambling player 204 to share their experience with other back-betting players 208 that may not be co-located with the primary gambling player 204. The inputs from the image capture device and/or microphone can be streamed across the communication network 104 to the back-betting player's 208 computational device 152. Alternatively or additionally, the EGM 108 may be equipped with an image capture device and/or microphone to capture the primary gambling player 204 during their gameplay session and that input may be streamed to the computational device 152 of the back-betting player 208 via the communication network 104.

In some embodiments, the primary gambling player 204 may stream their gameplay information captured via the computational device 244 and/or EGM 108 to a dedicated streaming service. Alternatively or additionally, the wagering system 156 may include functionality to provide a streaming service for the primary gambling player 204. In some embodiments, the primary gambling player 204 may utilize the streaming service to allow a back-betting player(s) 208 to chat with the primary gambling player 204, view the gameplay session of the primary gambling player 204, and/or place back-bets on the primary gambling player's 204 gameplay session with the EGM 108. As will be discussed in further detail herein, the primary gambling player 204 may use the streaming service to allow the back-betting players 208 to vote on whether or not to provide a bonus to the primary gambling player 204, to vote on triggers for bonuses, to vote on what type of bonus the primary gambling player 204 should play during a gameplay session, etc. The interaction between the primary gambling player 204 and back-betting player(s) 208 may also enable the voting of back-betting players 208 to provide the primary gambling player 204 with a win multiplier for their gameplay session. The multiplier may be increased depending upon the number of back-betting players 208 that are currently engaged in a back-betting session for the primary gambling player 204, based on the number of back-betting players 208 that are subscribers to the primary gambling player's 204 streaming account, based on the number of back-betting players 208 that are currently viewing the primary gambling player's 204 gameplay session, or combinations thereof. As an example, the primary gambling player 204 may receive a larger win multiplier as the number of back-betting players 208 or subscribers to the primary gambling player 204 increases. In some embodiments, the back-betting players 208 may also contribute to bonus pools available to the primary gambling player 204 and/or to back-bet pools that are tied to the gameplay session of the primary gambling player 204.

Figure 3A:
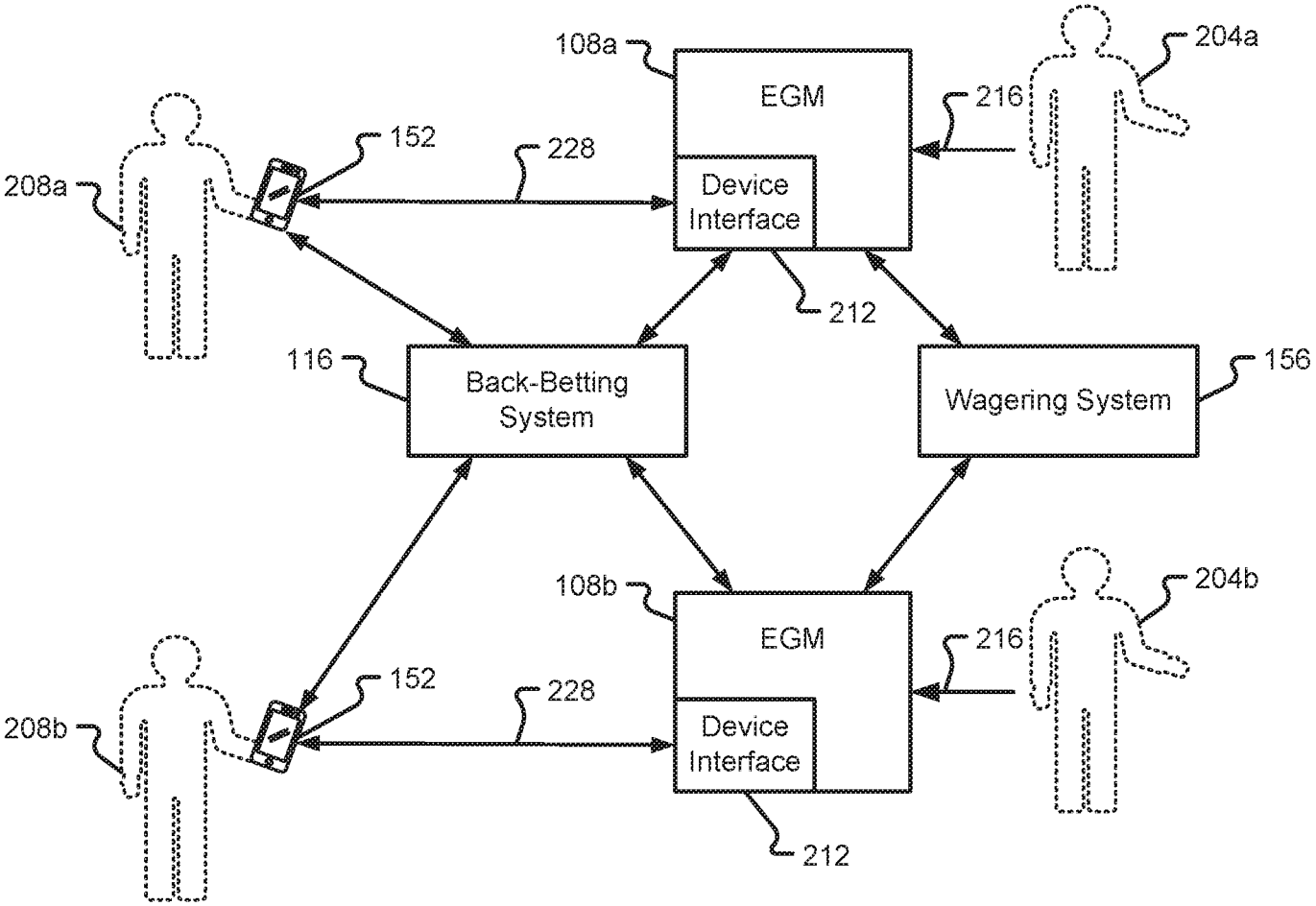
FIG. 3A is a block diagram depicting a first possible back-betting scenario in accordance with embodiments of the present disclosure.
Figure 3B:
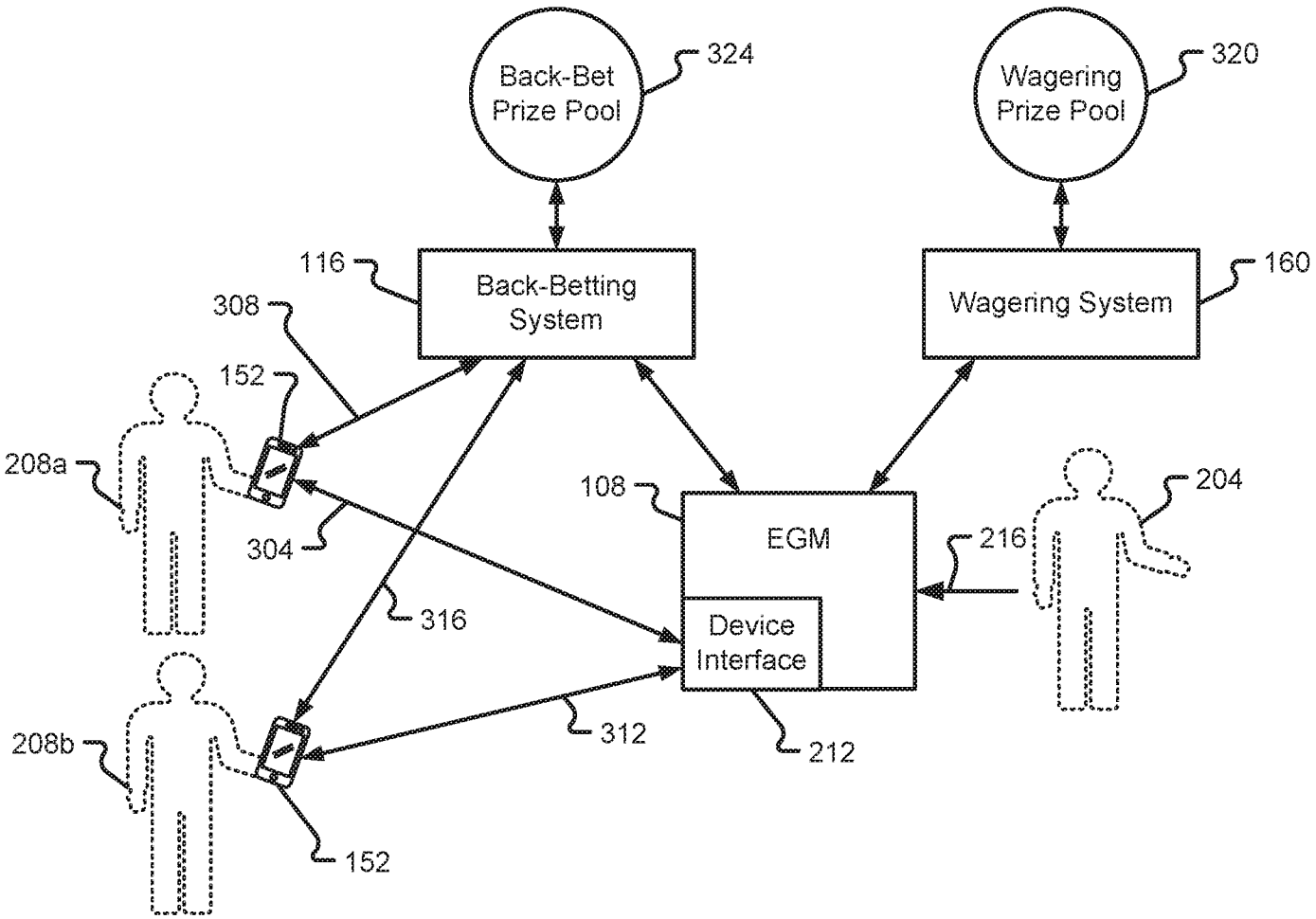
FIG. 3B is a block diagram depicting a second possible back-betting scenario in accordance with embodiments of the present disclosure.

With reference now to FIGS. 3A and 3B, various back-betting scenarios will be described in accordance with at least some embodiments of the present disclosure. Referring initially to FIG. 3A, a first back-betting scenario is shown where two different primary gambling players 204*a*, 204*b* are gambling on different EGMs 108*a*, 108*b*, respectively. In some embodiments, a first back-betting player 208*a* may be engaged in a first back-betting session with the first EGM 108*a* whereas the second back-betting player 208*b* may be engaged in a second back-betting session with the second EGM 108*b*. Thus, outcomes or events for games played by the first primary gambling player 204*a* at the first EGM 108*a* may affect back-bet wagers placed by the first back-betting player 208*a*, but not back-bet wagers placed by the second back-betting player 208*b*. Likewise, outcomes or events for games played by the second primary gambling player 204*b* at the second EGM 208*b* may affect back-bet wagers placed by the second back-betting player 208*b*, but not back-bet wagers placed by the first back-betting player 208*a*

FIG. 3A also shows that while multiple back-betting sessions are established simultaneously with different EGMs 108*a*, 108*b*, the various back-betting sessions can be simultaneously managed by a common back-betting system 116. Similarly, the wagering system 156 may be configured to simultaneously manage multiple gaming sessions at the various EGMs 108*a*, 108*b*.

FIG. 3B, on the other hand, shows a scenario where two or more back-betting players 208*a*, 208*b* are allowed to simultaneously establish a back-betting session with a common EGM (e.g., the second EGM 108). In some embodiments, the number of back-betting sessions simultaneously established with a particular EGM may be any number greater than one. Said another way, there does not necessarily need to be a limit placed on the number of back-betting sessions a single EGM 108 is allowed to be associated therewith. It is not necessarily a requirement that both back-betting players 208*a*, 208*b* place the same back-bets wagers or back-bet the same possible outcomes for the game of chance or skill being played by the primary gambling player 204. Said another way, each back-betting player 208*a*, 208*b* may be allowed to establish different back-betting sessions with the same EGM 108 such that one player's computational device 152 has a first pairing 304 established with the EGM 108 and the other player's computational device has a second pairing 312 established with the EGM 108. The different computational devices 152 may also establish unique communication pathways 308, 316 with the back-betting system 116 to ensure that the back-betting sessions are independently maintained.

FIG. 3B also shows that the wagering system 156 may be used to manage a wagering prize pool 320 and distribute awards or prizes from the wagering prize pool 320 to primary gambling players 204 based on outcomes at the EGMs 108. The back-betting system 116, on the other hand, may be configured to manage a back-bet prize pool 324 and distribute awards or prized from the back-bet prize pool 324 to back-betting players 208 based on results of back-betting sessions. The distribution of awards or prizes from the back-bet prize pool 324 may be conditional upon events that occur at the EGM 108 for the primary gambling player 204 whereas the distribution of awards or prizes from the wagering prize pool 320 may be based on outcomes of the games played by the primary gambling player 204 at the EGM 108. In some embodiments, a distribution of an award or prize from the wagering prize pool 320 to the primary gambling player 204 may correspond to an event that was back-bet wagered. In this particular situation, a distribution of an award or prize from the wagering prize pool 320 may result in an automatic distribution of an award or prize from the back-bet prize pool 324 if a corresponding back-bet was placed for the event of distribution to the primary gambling player 204 at the particular EGM 108 being played by the player 204. Accordingly, there may be different odds associated with a distribution of an award or prize from the wagering prize pool 320 as compared to a distribution of an award or prize from the back-bet prize pool 324.

In some embodiments, the back-bet prize pool 324 may be at least partially funded by the wagering prize pool 320 or vice versa. For example, the primary gambling player 204 on the EGM 108 could see no additional compensation when other players back-bet. In other embodiments, the primary gambling player 204 may receive a financial award from back-bets placed on the EGM 108 being played by the primary gambling player 204. In a simple but non-limiting example, the primary gambling player 204 may receive a fixed percentage of winnings from each back-better 208*a*, 208*b*. In other example, the primary gambling player 204 may receive a fixed fee or a percentage of each back-bet placed by the back-betting players 208*a*, 208*b*. As still another example, the primary gambling player 204 may receive a scaled fee based on some criteria, such as denomination or the number of concurrent back-betters, of the back-better's winnings.

Although not depicted, another possible back-betting scenario may involve a single back-betting player establishing a plurality of different back-betting sessions with different EGMs. Thus, the computational device 152 may be associated with a plurality of different EGMs and the back-betting player may utilize the computational device 152 to place a plurality of different back-bets on different EGMs via different back-betting sessions.

Figure 4:
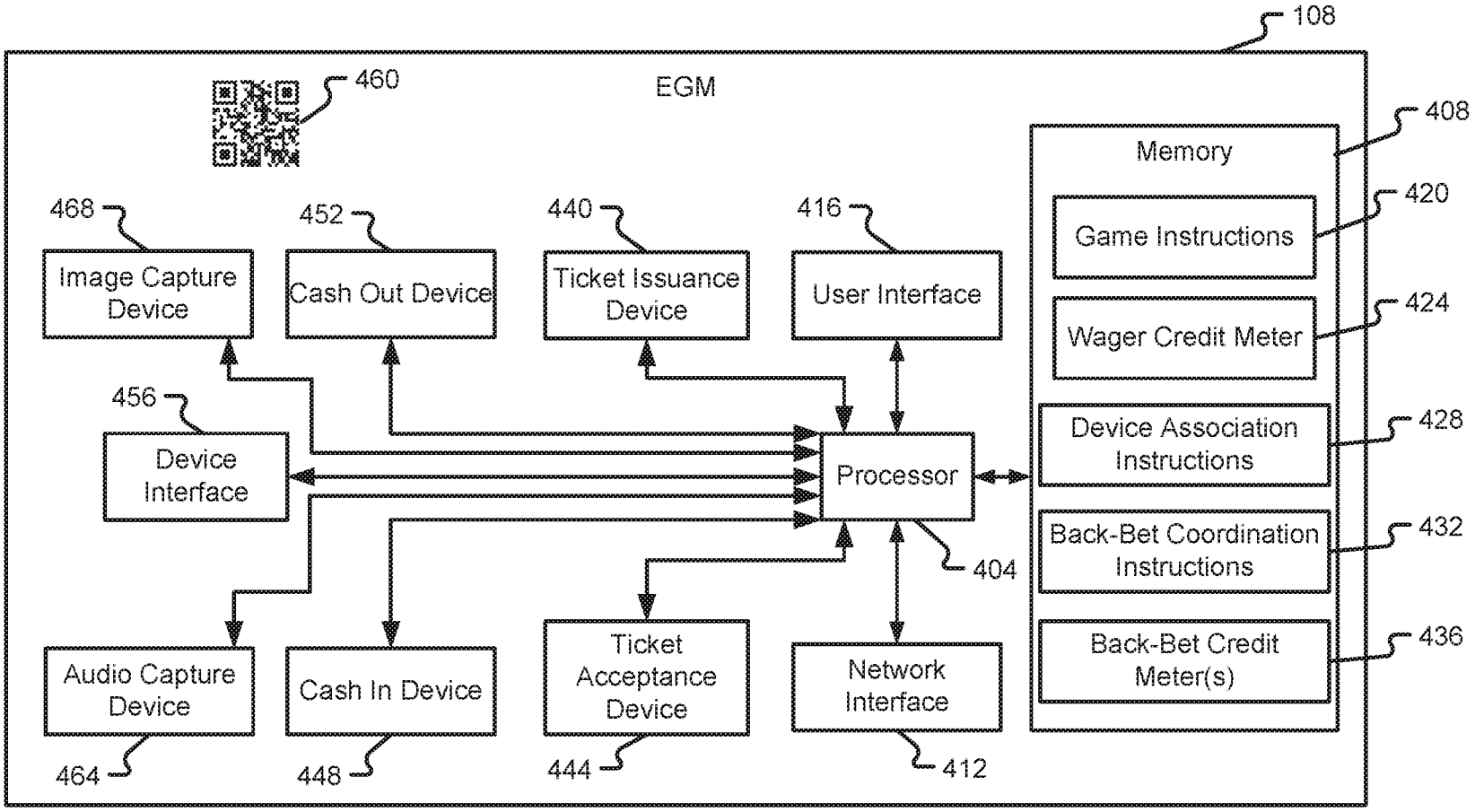
FIG. 4 is a block diagram depicting an illustrative EGM in accordance with embodiments of the present disclosure.

With reference now to FIG. 4, additional details of an EGM 108 will be described in accordance with at least some embodiments of the present disclosure. While embodiments will be discussed with reference to an EGM, it should be appreciated that a table game 156 or the like may have at least some components in common with the depicted EGM 108. For instance, a table game 156 may have an optical code or QR code 460 provided thereon that enables a computational device 152 to associate itself with the table game 156 or a player at the table game and thereby establish a back-betting session for the table game 156 or the player at the table game.

The EGM 108 is depicted to include a processor 404, memory 408, a network interface 412, a user interface 416, a ticket issuance device 440, a ticket acceptance device 444, a cash in device 448, a cash out device 452, a device interface 456, an audio capture device 464, and an image capture device 468. In some embodiments, the processor 404 may be similar or identical to the processor 120. In other words, the processor 404 may correspond to one or many microprocessors, CPUs, microcontrollers, or the like. The processor 404 may be configured to execute one or more instruction sets stored in memory 408.

The network interface 412 may also be similar or identical to network interface 128 or 132. The nature of the network interface 412, however, may depend upon whether the network interface 412 is provided in an EGM 108 or the nature of the device interface 212. Examples of a suitable network interface 412 include, without limitation, an Ethernet port, a USB port, an RS-232 port, an RS-485 port, a NIC, an antenna, a driver circuit, a modulator/demodulator, etc. The network interface 412 may include one or multiple different network interfaces depending upon whether the EGM 108 is connecting to a single communication network 104 or multiple different types of communication networks 104. For instance, the EGM 108 may be provided with both a wired network interface and a wireless network interface without departing from the scope of the present disclosure.

The user interface 416 may correspond to any type of input and/or output device that enables the player 112, 204 to interact with the EGM 108. As can be appreciated, the nature of the user interface 416 may depend upon the nature of the EGM 108. For instance, if the EGM 108 is a traditional mechanical reel slot machine, then the user interface 416 may include one or more mechanical reels with symbols provided thereon, one or more lights or LED displays, one or more depressible buttons, a lever or "one armed bandit handle", a speaker, or combinations thereof. If the EGM 108 is a digital device, then the user interface 416 may include one or more touch-sensitive displays, LED/LCD display screens, etc.

The memory 408 may be similar or identical to memory 124. For instance, the memory 408 may include one or multiple computer memory devices that are volatile or non-volatile. The memory 408 may be configured to store instruction sets that enable player interaction with the EGM 108, that enable game play at the EGM 108, and/or that enable coordination with the wagering system 160 or back-betting system 116. Examples of instruction sets that may be stored in the memory 408 include a game instruction set 420, a wager credit meter 424, a device association instruction set 428, a back-bet coordination instruction set 432, and one or more back-bet credit meters 436.

In some embodiments, the game instructions 420, when executed by the processor 404, may enable the EGM 108 to facilitate one or more games of chance or skill and produce interactions between the player 112 and the game of chance or skill. In some embodiments, the game instruction set 420 may include subroutines that present one or more graphics to the player 112 via the user interface 416, subroutines that calculate whether a particular wager has resulted in a win or loss during the game of chance or skill, subroutines for determining payouts for the player 112 in the event of a win, subroutines for exchanging communications with a connected server (e.g., a server of the back-betting system 116 and/or a server of the wagering system 160), subroutines for enabling the player 112, 204 to engage in a game using their computational device 152, and any other subroutine or set of instructions that facilitate gameplay at or in association with the EGM 108.

The wager credit meter 424 may correspond to a secure instruction set and/or data structure within the EGM 108 that facilitates a tracking of activity at the EGM 108. In some embodiments, the wager credit meter 424 may be used to store or log information related to various player 112 activities and events that occur at the EGM 108. The types of information that may be maintained in the wager credit meter 424 include, without limitation, player information, available credit information, wager amount information, and other types of information that may or may not need to be recorded for purposes of accounting for wagers placed at the EGM 108 and payouts made for a player 112, 204 during a game of chance or skill played at the EGM 108. In some embodiments, the wager credit meter 424 may be configured to track coin in activity, coin out activity, coin drop activity, jackpot paid activity, bonus paid activity, credits applied activity, external bonus payout activity, ticket/voucher in activity, ticket/voucher out activity, timing of events that occur at the EGM 108, and the like. In some embodiments, certain portions of the wager credit meter 424 may be updated in response to outcomes of a game of chance or skill played at the EGM 108. Some or all of the data within the wager credit meter 424 may be reported to the wagering system 160 and/or back-betting system 116, for example, if such data applies to a centrally-managed game involving a progressive prize pool. As an example, the number, value, and timing of wagers placed by a particular player 112 and payouts on such wagers may be reported to the wagering system 160. Likewise, status of the wager credit meter 424 may be reported to the back-betting system 116 if such information relates to a back-bet placed by a back-betting player 208.

The device association instruction set 428, when executed by the processor 404, may enable the EGM 108 to create an association with a computational device 152, perhaps for the purposes of establishing a back-betting session with the computational device 152. In some embodiments, the device association instruction set 428 is configured to pair with a computational device 152 and possibly establish a communication link 228, such as a Bluetooth, BLE, WiFi, or NFC communication link. The device association instruction set 428 may also include instructions for discontinuing an association with a computational device 152. For example, the device association instruction set 428 may be configured to unpair or disassociate the EGM 108 from the computational device 152 when it is determined that a back-betting session should come to a conclusion. In some embodiments, the device association instruction set 428 may be configured to operate a device interface 456, which may be similar to device interface 212. For instance, the device association instruction set 428 may be configured to enable the device interface 456 to pair with a corresponding device interface of the computational device 152 and to exchange communications over the communication channel established between the devices. As a non-limiting example, the device interface 456 may include a wireless antenna and the device association instruction set 428 may include a driver for the antenna and instructions that enable the exchange of communications with the antenna.

The back-bet coordination instruction set 432, when executed by the processor 404, may enable the EGM 108 to establish and manage back-betting sessions with one or multiple computational devices 152. The back-bet coordination instruction set 432 may also be configured to determine whether an event at the EGM 108 relates to a back-bet placed during a back-betting session and, if such a determination is made, then report state-of-play information regarding that event to the back-betting system 116 and/or computational device 152, as appropriate. The back-bet coordination instruction set 432 may also be responsible for synchronizing back-bet wagers placed at a computational device 152 with respect to a game being played at the EGM 108, for example, to ensure that such back-bet wagers are timely placed with respect to the timing of game events at the EGM 108. The back-bet coordination instructions 432, in some embodiments, may be configured to cooperate with the back-bet management instruction set 140 maintained at the back-betting system 116. In embodiments where the EGM 108 operates as a central manager of a back-betting session, then it may be desirable to also enable some functions of the back-bet management instructions 140 in the back-bet coordination instructions 432.

The back-bet credit meter(s) 436 may be used to manage or track a status of back-bets placed during back-betting sessions that involve the EGM 108. In some embodiments, the back-bet credit meters 436 may include one or more meters that: record the transfers credits onto the EGM 108 for back-bets; record the transfers credits off the EGM 108 associated with back-bets; a credit meter to hold funds associated with transfers onto the EGM 108, or wins associated with back-bets; a meter for tracking historical wagers associated with back-bets; and a meter for tracking historical game awards associated with back-bets. It should be appreciated that the back-bet credit meter(s) 436 may be managed on a per-EGM basis, or on a per-back-better basis, or on a per-session basis.

Because the EGM 108 may be used for the acceptance and issuance of tickets/vouchers, the EGM 108 may be provided with appropriate hardware to facilitate such acceptance and issuance. Specifically, the EGM 108 may be provided with a ticket acceptance device 444 that is configured to accept or scan physically-printed tickets/vouchers and extract appropriate information therefrom. In some embodiments, the ticket acceptance device 444 may include one or more machine vision devices (e.g., a camera, IR scanner, optical scanner, barcode scanner, etc.), a physical ticket acceptor, a shredder, etc. The ticket acceptance device 444 may be configured to accept physical tickets and/or electronic tickets without departing from the scope of the present disclosure. An electronic ticket/voucher may be accepted by scanning a barcode or QR code displayed by a player's 112 computational device 152, for example.

The ticket issuance device 440 may be configured to print or provide physical tickets/vouchers to players 112. In some embodiments, the ticket issuance device 440 may be configured to issue a ticket/voucher consistent with an amount of credit available to a player 112, possibly as indicated within the wager credit meter 424.

The cash in device 448 may include a bill acceptor, a coin acceptor, a chip acceptor, or the like. In some embodiments, the cash in device may also include credit card reader hardware and/or software. The cash out device 452, like the ticket issuance device 440, may operate and issue cash, coins, tokens, or chips based on an amount indicated within the wager credit meter 424. In some embodiments, the cash out device 452 may include a coin tray or the like and counting hardware configured to count and distribute an appropriate amount of coins or tokens based on a player's 112 winnings or available credit within the wager credit meter 424.

The EGM 108 is also shown to include a substantially unique code 460 printed thereon or displayable by the user interface 416 of the EGM 108. In some embodiments, the substantially unique code 460 may be used as a mechanism for pairing or associating the EGM 108 with a computational device 152 for purposes of establishing a back-betting session. In some embodiments, the substantially unique code 460 may correspond to a QR code, barcode, or the like that substantially uniquely identifies the EGM 108 from among other EGMs in the gaming system 100. Information contained in the substantially unique code 460 may be used by a computational device 152 to establish a back-betting session by, for example, identifying the EGM 108 to the back-betting system 116. In some embodiments, the substantially unique code 460 may not be a printed or visible code, but rather may be an electronic code that is communicated to the computational device 152 via a proximity-based communication protocol (e.g., NFC, Bluetooth, BLE, etc.).

The audio capture device 464 may include one or multiple transducers that are capable of converting audible sounds into an electronic signal. As an example, the audio capture device may correspond to a microphone that is capable of capturing audio inputs at or near the EGM 108. In some embodiments, the audio inputs captured by the audio capture device may be streamed to other back-betting players 208 via the network interface 412.

The image capture device 468 may include one or multiple transducers that are capable of converting light into an electronic signal. As an example, the image capture device 468 may include a camera, video camera, etc. that is capable of capturing still images and/or motion images of the primary gambling player 204 when positioned in front of the EGM 108. The image(s) captured by the image capture device 468 may be streamed to other back-betting players 208 via the network interface 412. In some embodiments, video content captured by the image capture device 468 may be synchronized with audio content captured by the audio capture device 464 when sent along the network interface 412.

Figure 5:
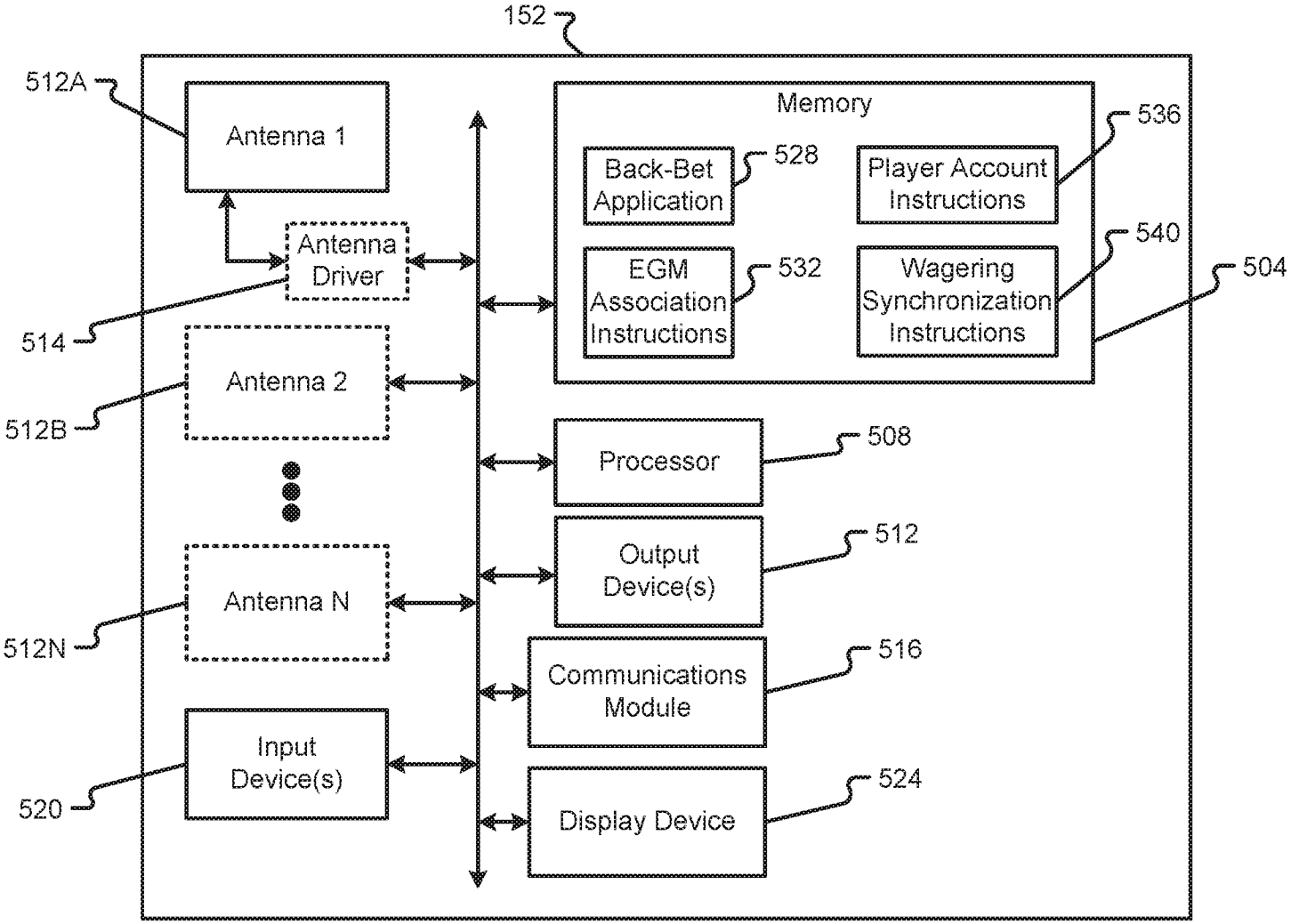
FIG. 5 is a block diagram depicting an illustrative user computational device in accordance with embodiments of the present disclosure.

With reference now to FIG. 5, additional details of a computational device 152 will be described in accordance with at least some embodiments of the present disclosure. The computational device 152 may include one or more components, such as, a memory 504, a processor 508, an antenna 512A-N, a communications module 516, one or more input devices 520, and one or more display devices 524. In some embodiments, the computational device 152 may further include a power module.

The memory 504 of the computational device 152 may be used in connection with the execution of application programming or instructions by the processor 508, and for the temporary or long-term storage of program instructions and/or data. The memory 504 may contain executable functions that are used by the processor 508 to run other components of the computational device 152. In one embodiment, the memory 504 may be configured to store various instruction sets that are executable by the processor 508. Examples of such instruction sets include, without limitation, a back-bet application 528, an EGM association instruction set 532, a player account instruction set 536, and a wagering synchronization instruction set 540.

The back-bet application 528, when executed by the processor 508, may enable a back-betting player 208 to engage in back-betting sessions, place back-bet wagers, receive state-of-play information from the EGM 108, communicate with the back-betting system 116, and the like. In some embodiments, the back-betting application 528 may enable the establishment of a back-betting session between the user computational device 152 and a back-betting system 116 when the user computational device 152 is associated with an asset of the gaming system (e.g., an EGM 108). The back-bet application 528 may further enable exchange of back-bet wager information via the back-betting system 116 and restrict the placement of back-bets with the back-betting system 116 when the user computational device 152 is not associated with the asset of the gaming system.

Some of the above-described functionality of the back-bet application 528 may be facilitated by cooperation with the EGM association instruction set 532. In some embodiments, the association instruction set 532 may enable the user computational device 152 to be associated with and dissociated from an EGM 108 or the like. In some embodiments, the association instruction set 532 may be similar to the device association instruction set 428 and may be configured to exchange communications with the EGM 108 by establishing a wireless communication link between the computational device 152 and EGM 108. In other embodiments, the association instructions 532 may be configured to operate an input device 520 (e.g., a camera or image capture device) to obtain information provided by the substantially unique code 460. The association instruction set 532 may further be configured to enable the computational device 152 to report an association with an asset, such as an EGM 108, to the back-betting system 116 for purposes of establishing and maintaining a back-betting session with respect to the EGM 108.

The player account instruction set 536, when executed by the processor 508, may enable the computational device 152 to manage a player account that belongs to the owner of the computational device 152. For instance, the player account instruction set 536 may be configured to manage a player loyalty account, manage available wager credits for a player within the player loyalty account, and manage other cashless wagering functions for the player. In some embodiments, the player account instruction set 536 may be configured to update a player account based on direct wager activity with an asset, such as an EGM 108, as well as back-betting activity.

The wagering synchronization instruction set 540, when executed by the processor 508, may enable the computational device 152 to ensure back-bet wagers made at the computational device 152 are timely made with respect to game events at the EGM 108. In some embodiments, the wagering synchronization instruction set 540 may have access to state-of-play information from the EGM 108. Such state-of-play information may be received directly from the EGM 108 or via the back-betting system 116. In some embodiments, the wagering synchronization instruction set 540 may be configured to access a clock of the user computational device 152 (e.g., a clock within the processor 508) and determine a time when a back-bet wager is placed with respect to an event of the asset. This information may be communicated to the back-bet application 528 to ensure that the back-bet is timely made.

In some embodiments, the memory 504 may be similar or identical to other memory depicted and described herein (e.g., memory 124 and/or memory 408). As an example, the memory 504 may comprise volatile or non-volatile memory. Non-limiting examples of memory 504 that may be utilized in the computational device 152 include RAM, ROM, buffer memory, flash memory, solid-state memory, or variants thereof.

The processor 508 may be similar or identical to other processors depicted and described herein (e.g., processor 120 and/or processor 404). As an example, processor 508 may include one or many microprocessors, microcontrollers, CPUs, etc. that are contained within the housing of the computational device 152 with the memory 504. As with any other processor depicted and described herein, the processor 508 may be a multipurpose, programmable device that accepts digital data as input, processes the digital data according to instructions stored in its internal memory, and provides results as output. The processor 508 implements sequential digital logic as it has internal memory. As with most known microprocessors, the processor 508 may operate on numbers and symbols represented in the binary numeral system.

The one or more antennas 512A-N may be configured to enable wireless communications between the computational device 152 and an EGM 108, a wearable device, and/or some other device. As can be appreciated, the antenna(s) 512A-N may be arranged to operate using one or more wireless communication protocols and operating frequencies including, but not limited to, Bluetooth®, BLE, NFC, ZigBee, GSM, CDMA, WiFi, RF, and the like. By way of example, the antenna(s) 512A-N may be RF antenna(s), and as such, may transmit RF signals through free-space to be received by an EGM 108 having an RF transceiver in the form of the device interface 456. One or more of the antennas 512A may be driven or operated by a dedicated antenna driver 514.

In some embodiments, the computational device 152 may include a power module. The power module may be configured to provide power to the parts of the computational device 152 in order to operate. The power module may store power in a capacitor of the power module. In one embodiment, electronics in the power module may store energy in the capacitor and turn off when an RF field is present. This arrangement can ensure that energy is presented to the computational device 152 minimizing any effect on read distance. For example, the power module may include a battery or other power source to supply power to parts of the computational device 152. The power module may include a built-in power supply (e.g., battery) and/or a power converter that facilitates the conversion of externally-supplied AC power into DC power that is used to power the various components of the computational device 152. In some embodiments, the power module may also include some implementation of surge protection circuitry to protect the components of the computational device 152 from power surges.

The computational device 152 may include a communications module 516 that is configured to communicate with one or more different systems or devices either remote or local to the computational device 152. Thus, the communications module 516 can send or receive messages to or from servers, EGMs 108, other computational devices 152, or any other network-connected device.

The input device(s) 520 may include at least one device sensor. Among other things, a device sensor may be configured to detect a state of the computational device 152 or location of the computational device 152. In some embodiments, the input device(s) 520 may also include an image capture device, such as a camera, that is configured to capture an image of an optical code 460 provided on an EGM 108.

In some embodiments, the computational device 152 may include a user interface. The user interface may or may not include one or more input devices 520, output devices 512, and/or display devices 524. Examples of suitable user input devices that may be included in the user interface include, without limitation, buttons, keyboards, mouse, touch-sensitive surfaces, pen, camera, microphone, etc. Examples of suitable user output devices and/or display devices that may be included in the user interface include, without limitation, display screens, touchscreens, lights, speakers, etc. It should be appreciated that the user interface may also include a combined user input and user output device, such as a touch-sensitive display or the like.

The network interface may comprise hardware that facilitates communications with other communication devices over the communication network 104. The network interface may include an Ethernet port, a Wi-Fi card, a Network Interface Card (NIC), a cellular interface (e.g., antenna, filters, and associated circuitry), or the like. The network interface may be configured to facilitate a connection between the computational device 152 and the communication network 104 and may further be configured to encode and decode communications (e.g., packets) according to a protocol utilized by the communication network 104.

Figure 6:
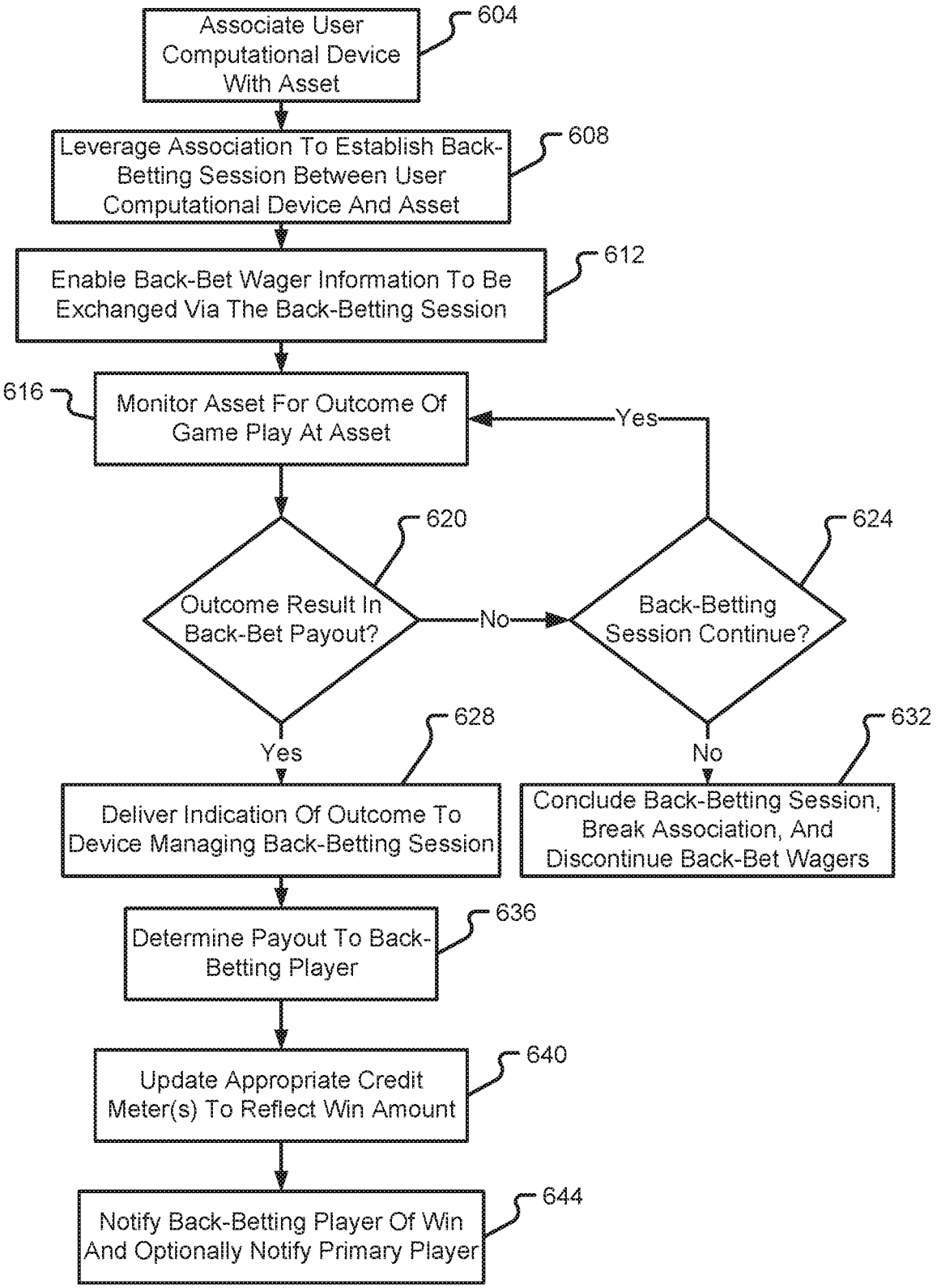
FIG. 6 is a flow diagram depicting a back-betting method in accordance with embodiments of the present disclosure.

With reference now to FIG. 6, a first back-betting method will be described in accordance with at least some embodiments of the present disclosure. The method begins when a computational device 152 is associated with an asset of a gaming system (step 604). In some embodiments, the asset corresponds to an EGM 108, a table game 156, or the like. In some embodiments, the association may be established between the computational device 152 and a primary gambling player at an asset, but at least some information from the asset being played by the primary gambling player may be included to create the association. In some embodiments, the association may be achieved by pairing the computational device 152 with a device interface 212, 456 of the EGM 108. Such a pairing may be achieved using Bluetooth, BLE, NFC, WiFi, or any other proximity-based communication protocol.

The method continues by leveraging the association established in step 604 to establish a back-betting session between a user of the computational device 152 and the asset (step 608). In some embodiments, the user of the computational device 152 involved in the back-betting session may be considered a back-betting player 208. This particular player may or may not also be a primary gambling player 204. In some embodiments, establishment of the back-betting session may be achieved via direct communications between the computational device 152 and back-betting system 116. In some embodiments, establishment of the back-betting session may be achieved via communications between the computational device 152 and asset/EGM 108 or by communications that flow through the EGM 108 to the back-betting system 116.

The method continues by enabling the exchange of back-bet wager information via the back-betting session (step 612). In some embodiments, the exchange of back-bet wager information may include a presentation of available back-bets to the computational device 152, a presentation of odds for available back-bets, placement of back-bet wagers made at the computational device 152, timing of such back-bet wagers, an exchange of state-of-play information between the various devices involved in the back-betting session, and so on. As a game at the asset continues, the game itself may be monitored for an outcome (step 616). The outcome of the game may be monitored, in some embodiments, to determine if a back-bet associated with the game is resulting in a payout (step 620). If this query is answered negatively, then the method continues as long as the back-betting session continues (step 624). Once the back-betting session is completed as determined at step 624, the back-betting session will be concluded, the association between the computational device 152 and asset may be broken, and the back-betting system may discontinue accepting back-bet wagers from the now-disassociated computational device 152 (step 632).

Referring back to step 620, if the outcome of the game is determined to result in a back-bet payout, then the method will continue by delivering an indication of the game outcome to the device managing the back-betting session (step 628). In some embodiments, the device managing the back-betting session may correspond to the asset at which the game is being played, a back-betting system 116, the computational device 152, or a combination thereof.

The method further continues by determining the payout to make to the back-betting player based on the amount of the back-bet wager, the nature of the event that resulted in the payout, and whether other players are also being paid on the same event via a different back-betting session (step 636). In some embodiments, a back-betting player may be paid back-bet winnings from a back-bet prize pool 324. In some embodiments, a payout based on the back-bet placed by the back-betting player may also be made to the primary gambling player and such a payout may be made from the back-bet prize pool 324 or the wagering prize pool 320.

The method then continues by updating the appropriate credit meter(s) within the gaming system 100 to reflect the win amount (step 640). In some embodiments, credit meter(s) may be updated to reflect both the payout to the primary gambling player and the payout to any back-betting players. The credit meter(s) that are updated may correspond to credit meter(s) maintained at an EGM 108, credit meter(s) maintained at the back-betting system 116, credit meter(s) maintained at the wagering system 160, credit meter(s) maintained at a computational device 152, or combinations thereof. The method may then continue by notifying the back-betting player of the win and optionally notifying the primary gambling player of the back-betting player's win (step 644). The notification to the back-betting player may be achieved by the computational device 152 whereas the notification to the primary gambling player may be made via the asset being played by the primary gambling player. In some embodiments, the decision of whether or not to notify the primary gambling player may be controlled by notification rules and/or preferences defined for the back-betting session.

Figure 7:
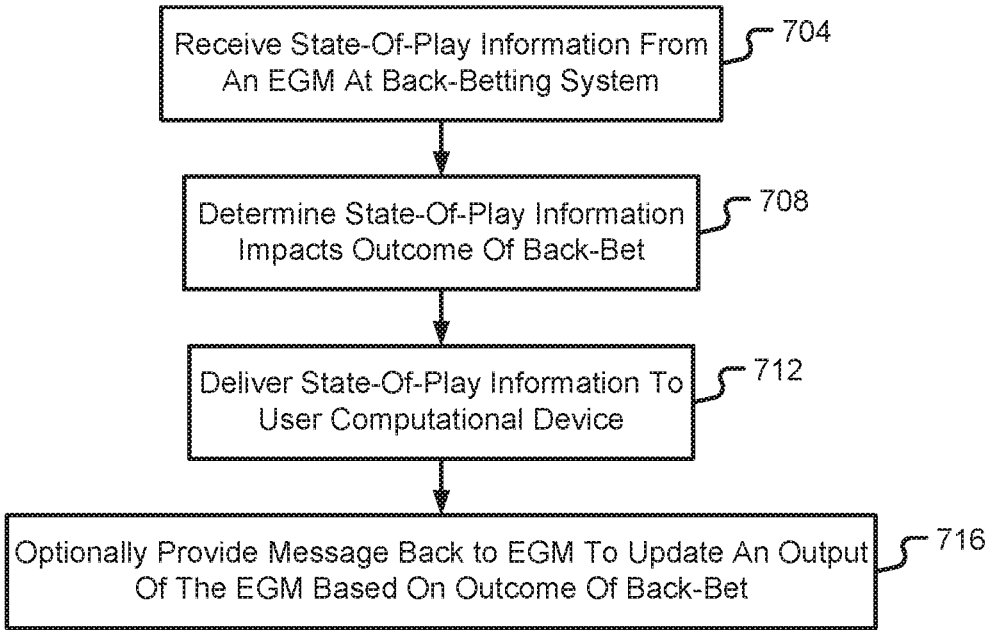
FIG. 7 is a flow diagram depicting another back-betting method in accordance with embodiments of the present disclosure.

With reference now to FIG. 7, another back-betting method will be described in accordance with at least some embodiments of the present disclosure. The method begins when state-of-play information is received at a back-betting system 116 from an EGM 108 (step 704). In some embodiments, the state-of-play information may include any information related to events at the EGM 108, a series of events at the EGM 108, or the like. In an alternative configuration, the state-of-play information may be communicated to the back-betting system 116 from the wagering system 160.

The method continues with the back-betting system 116 determining if the state-of-play information impacts an outcome of any pending or outstanding back-bets (step 708). In response to determining that an outcome of an outstanding back-bet has been impacted the back-betting system 116 may determine that some of the state-of-play information is to be delivered to the computational device 152 on which the back-bet was placed. In response, the back-betting system 116 may deliver the appropriate or relevant state-of-play information to the computational device 152 (step 712). In some embodiments, the state-of-play information may be communicated to the computational device 152 while bypassing the EGM 108. In some embodiments, the state-of-play information may be communicated to the computational device 152 via the EGM 108, either directly or by the back-betting system 116 communicating through the EGM 108 with the computational device 152.

The method then continues by optionally providing a message or communication back to the EGM 108 to update an output of the EGM 108 based on the outcome of the back-bet (step 716). In some embodiments, the decision to message the EGM 108 and provide a notification to the primary gambling player may be controlled by back-betting rules and/or preferences. Such rules and preferences may be controllable by the back-betting player, the primary gambling player, the EGM 108, the computational device 152, the back-betting system 116, combinations thereof, or the like. Such rules and preferences may be modifiable or set to default values.

Figure 8:
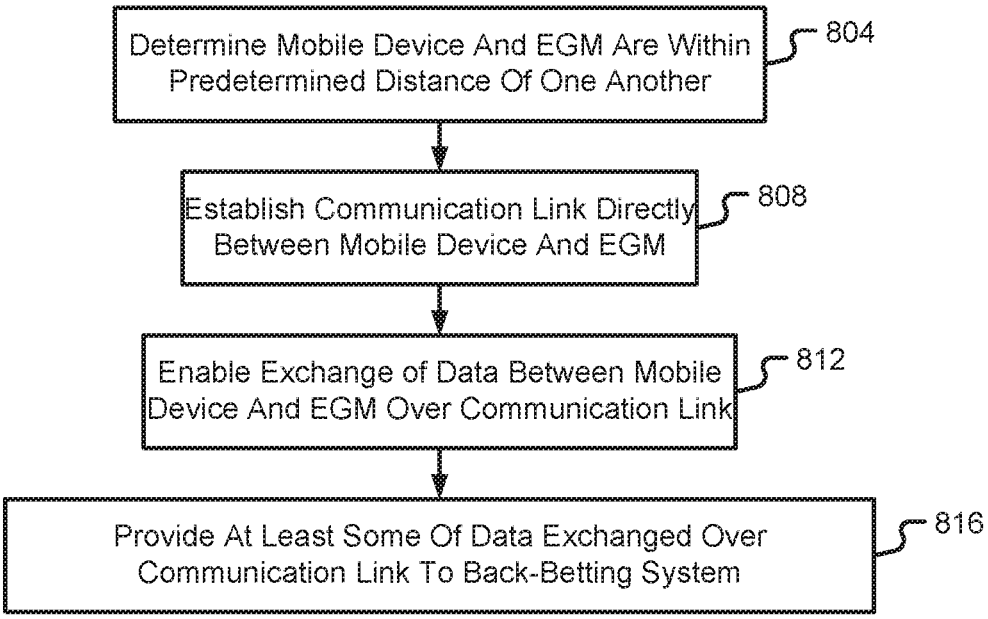
FIG. 8 is a flow diagram depicting another back-betting method in accordance with embodiments of the present disclosure.

With reference now to FIG. 8, another back-betting method will be described in accordance with at least some embodiments of the present disclosure. The method begins by determining that a computational device 152, such as a mobile device, and an asset, such as an EGM 108, are within a predetermined distance of one another (step 804). This may be determined automatically in response to the devices being brought within a wireless communication range of one another and/or by independently tracking a location of the devices 152, 108 and then determining that the locations are within a predetermined distance of one another. In other embodiments, this step may be performed when the mobile device is brought within range of the EGM 108 sufficient to enable the mobile device to capture an image of the EGM's 108 substantially unique code 460.

The method continues by establishing a communication link directly between the mobile device and EGM 108 (step 808). The communication link established between the devices may utilize to a proximity-based communication protocol and may be established automatically when the devices are brought within a predetermined distance of one another. Alternatively, this step may be performed when the mobile device obtains the substantially unique optical code 460 and then uses information therefrom to establish a communication link with the EGM 108.

Once the communication link is established, the method continues by enabling an exchange of data between the mobile device and the EGM 108 over the communication link (step 812). In some embodiments, back-bet wager information and/or state-of-play information may be exchanged over the communication link. It should be appreciated that other types of data may be exchanged over the communication link such as back-bet wagers placed by the mobile device. In some embodiments, the devices may exchange clock or timer information from their respective clocks to help facilitate the synchronization and enforcement of back-bets placed at the mobile device with respect to the EGM 108.

The method then continues by providing at least some of the data exchanged over the communication link to the back-betting system 116 (step 816). In some embodiments, the EGM 108 may take information received over the communication link and forward the information to the back-betting system 116. In some embodiments, the mobile device may take information received over the communication link and forward the information to the back-betting system 116. This distribution of information to the back-betting system 116 can help the back-betting system manage a back-betting session between the mobile device and EGM.

Figure 9:
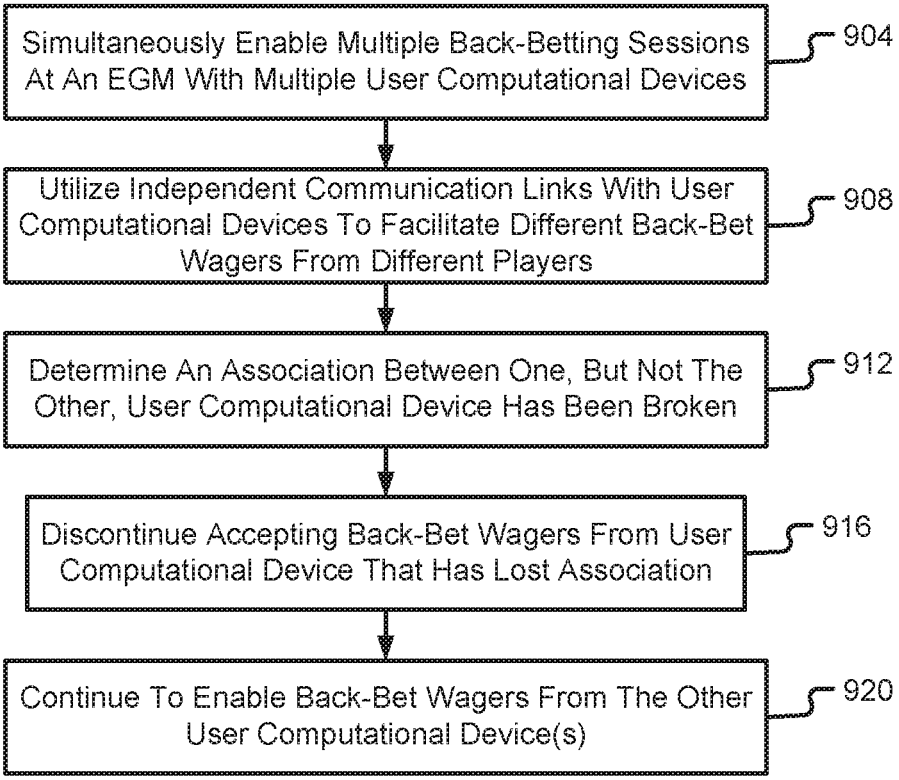
FIG. 9 is a flow diagram depicting another back-betting method in accordance with embodiments of the present disclosure.

With reference now to FIG. 9, another back-betting method will be described in accordance with at least some embodiments of the present disclosure. The method begins by allowing an EGM 108 to simultaneously having multiple back-betting sessions associated therewith (step 904). The multiple back-betting sessions may be established by different back-betting players using different computational devices 152 or by a single back-betting player using different computational devices 152. The establishment of the various back-betting sessions may be enabled using any of the methods disclosed herein.

The method continues by enabling the EGM 108 to utilize independent communication links with the different computational devices 152 to manage the back-betting sessions (step 908). In some embodiments, each computational device 152 may use its independently-established communication link to manage the back-betting session for that computational device 152. In some embodiments, each computational device 152 may submit its own back-bet wager information to the EGM 108 via its unique communication link and each computational device 152 may receive state-of-play information that is specific to back-bets placed at the computational device 152, which may be the same or different from other back-bets placed by other computational devices 152.

The method continues with one computational device 152 breaking its association with the EGM 108 (step 912). This may occur without other computational devices 152 breaking their association with the same EGM 108. In some embodiments, when this occurs, the EGM 108 and/or back-betting system 116 may discontinue accepting back-bet wagers for the computational device 152 that has ended its association with the EGM 108 (step 916). Meanwhile, back-bet wagers from other computational devices 152 that are still associated with the EGM 108 may be accepted and winnings from such back-bet wagers may be applied to the back-betting players that hold the computational devices 152 (step 920).

Figure 10:
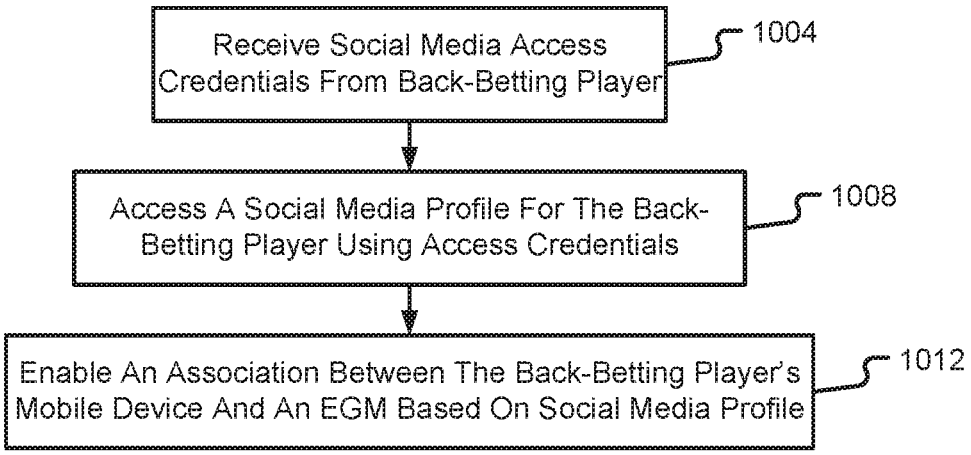
FIG. 10 is a flow diagram depicting another back-betting method in accordance with embodiments of the present disclosure.

With reference now to FIG. 10, another back-betting method will be described in accordance with at least some embodiments of the present disclosure. The method begins with the back-betting system 116 receiving social media access credential from a back-betting player (step 1004). The social media credentials received in this step may include username and/or password information for the back-betting player's social media profile.

The method may continue with the back-betting system accessing the social media profile, or a variant thereof, for the back-betting player by using the credentials received in step 1004 (step 1008). In some embodiments, the accessing may include sending a request for authentication from the back-betting system 116 to the associated social media website seeking a confirmation that the back-betting player has provided a valid set of social media credentials. The back-betting system 116 may or may not actually be provided with full access to the back-betting player's social media profile, but rather may simply receive an approved or disapproved confirmation back from the social media website.

The method then continues if the social media site provides the back-betting system 116 with a confirmation that valid credentials have been received. Specifically, the method may involve leveraging the confirmation to establish an association between the back-betting player's computational device 152 and an asset in the gaming system 100 (step 1012). For instance, the computational device 152 and asset may be configured to associate with one another after verification of the player's social media credentials such that a back-betting session can be established between the computational device 152 and asset.

Figure 11:
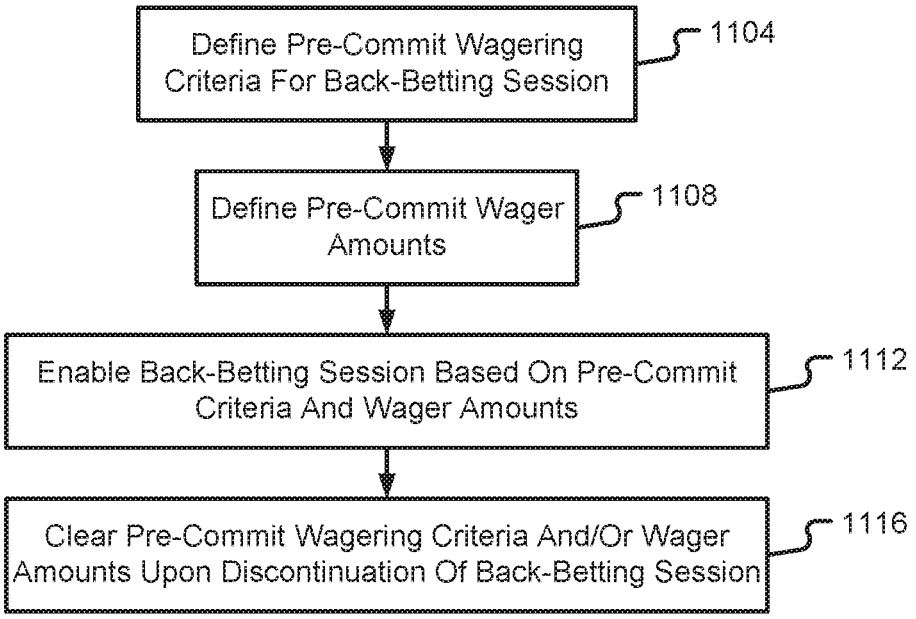
FIG. 11 is a flow diagram depicting another back-betting method in accordance with embodiments of the present disclosure.

With reference now to FIG. 11, another back-betting method will be described in accordance with at least some embodiments of the present disclosure. The method may include a pre-commit back-betting method in some embodiments. In the depicted embodiment, the method begins by defining pre-commit wagering criteria for a back-betting session between a computational device 152 and asset, such as an EGM 108 (step 1104). As a non-limiting example, the back-betting player may be allowed to pre-authorize matching the primary gambling player's wagers until one or more of the following criteria have been met:

- A maximum period of time has elapsed
- Up to a maximum wager amount
- Up to a maximum number of game cycles have occurred
- Until a certain win or loss threshold has been reached
- The primary gambling player on the EGM ends their session
- Loss of pairing or association with the EGM
- Bet (or modify bet) on a certain condition (e.g., place a back-bet when a game loses 3× in a row)

It is also possible for wagers and wins to be scaled. Thus, the method may also include defining pre-commit wager amounts, whether the same or different from wager amounts placed by the primary gambling player (step 1108). For instance, a back-betting player could define pre-commit wager amounts to be ½ of the wager placed by the primary gambling player on the base game, and the winning could be scaled based upon various criteria. For example, scaled math models specific to the base game could be published. Alternatively or additionally, the award amount could equal the scaling of the back-bet wager.

The method will then continue by enabling a back-betting session based on the pre-commit criteria and/or the pre-commit wager amounts defined in steps 1104 and 1108 (step 1112). These pre-commit wager criteria and/or wager amounts may continue to be enforced for additional back-betting wagers as long as the back-betting session is maintained. Once the back-betting session is discontinued (e.g., via a predetermined event occurring, programmatically, or in response to the back-betting player discontinuing the back-betting session), the method may proceed by clearing the pre-commit wager criteria and/or wager amounts (step 1116).

Figure 12:
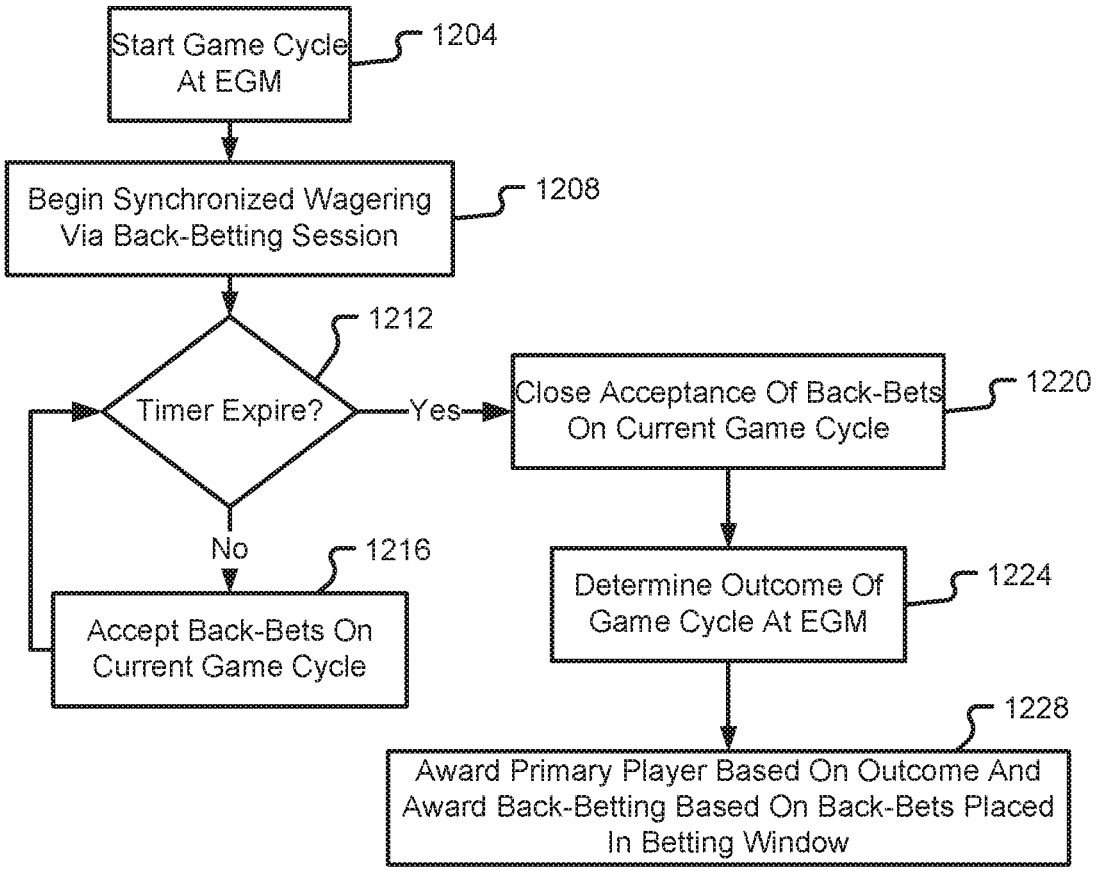
FIG. 12 is a flow diagram depicting another back-betting method in accordance with embodiments of the present disclosure.

With reference now to FIG. 12, another back-betting method will be described in accordance with at least some embodiments of the present disclosure. The method begins with an EGM starting a game cycle for a particular game of chance or skill being played by a primary gambling player (step 1204). The method continues with a back-betting session synchronizing itself with the in-progress game cycle (step 1208). In some embodiments, the primary gambling player on the base game can start a game cycle, and there is a small period time where back-betting players can place their back-bet wager before winnings are shown on the EGM 108. Accordingly, synchronization may begin after which point a timer starts to count for a predetermined period of time (step 1212). If a back-betting player doesn't place their back-bet wager within the pre-defined period of time, then they cannot partake in the winnings from the game cycle (step 1220). The timer may allow back-bets to be placed by one or a plurality of different back-betting players until the timer expires (step 1216).

Once the timer expires, the back-betting players will not be allowed to place a back-bet on the in-process game cycle whereas other back-betting players will be allowed to partake in back-bet winnings if the primary gambling player wins. This model may allow for back-bet wagers that don't match the wager placed by the primary gambling player placing the initial wager on the EGM 108. Accordingly, the method may continue by determining an outcome of the in-process game (step 1224) and then awarding players based on the outcome (step 1228). The primary gambling player may be awarded based on their wager placed directly with the EGM 108 whereas the back-betting players may be awarded based on the amount of their back-bet wagers. Accordingly, players placing back-bets could possibly select different wagering parameters, including, but not limited to: number of lines and/or bet per line.

In some embodiments, it may be possible for the back-betting players to be awarded game outcomes that the primary gambling player is not eligible for. In the case of a game outcome that requires the state of the game to uniquely change, such as hitting a top award, winning a progressive, or entering an in-game bonus (e.g., free spins, pick X or Y bonus, etc.), the base game may transition to the appropriate state. In this case, the reward from this additional state may be awarded to: (i) The back-betting player only, and the primary gambling player of the EGM 108 doesn't get any additional award or (ii) the winnings can be split in some equitable fashion between the primary gambling player and the back-betting player(s).

In another embodiment, the primary gambling player on the EGM 108 could ensure that all allowed back-betting players are betting some minimum bet level. The effect of the primary gambling player controlling the minimum bet level could have the effect of, but not limited to, better compensation to the primary gambling player or could affect eligibility to a particular bonus or prize.

If multiple EGM award triggers are encountered on the base game based upon the total bets from back-betting players and the primary gambling player, then the EGM 108 may take another action. For example, the EGM 108 may perform all transitions in an orderly fashion (e.g., play a free spin, play a pick X of Y bonus, hit a progressive, etc.). Alternatively or additionally, the EGM 108 may pick the transition which has the highest winning amount, best odds, or best risk/reward ratio.

Figure 13:
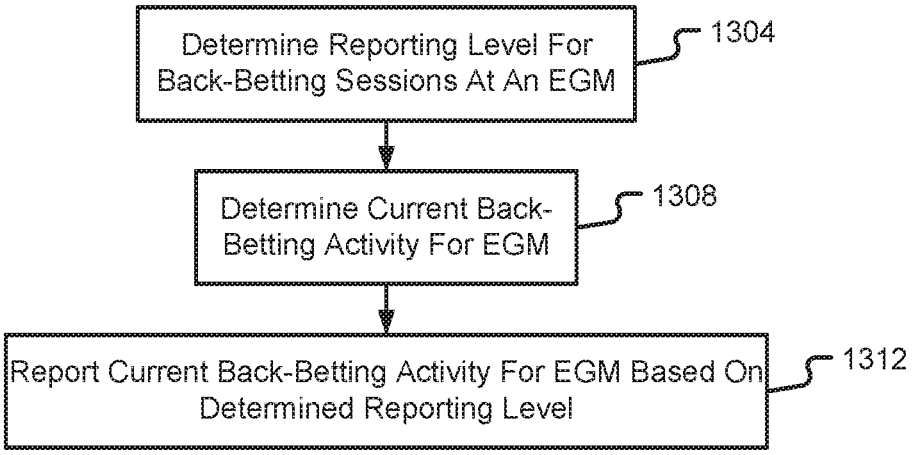
FIG. 13 is a flow diagram depicting another back-betting method in accordance with embodiments of the present disclosure.

With reference now to FIG. 13, another back-betting method will be described in accordance with at least some embodiments of the present disclosure. In some embodiments, back-betting can be performed anonymously meaning the primary gambling player will not know the identity of the back-betting player. In some embodiments, the primary gambling player may not even know that back-betting is occurring. Conversely, the primary gambling player may be presented information on the EGM 108 screen that would indicate back-betting was occurring on his/her game. Information could also be presented to the primary gambling player via the screen on the EGM 108 and it could specify the identity of the back-betting player or players. Alternatively, the primary gambling player may simply see a count of active back-betting players without being provided further information.

Accordingly, the method of FIG. 13 begins by determining a desired or allowable reporting level for back-betting sessions that are associated with an EGM 108 (step 1304). The reporting level may be predefined by the casino operator, by the back-betting player, or the primary gambling player. The reporting level may also be static or subject to change depending upon player preferences.

In some embodiments, the method continues by determining that a particular back-betting activity has occurred for the EGM 108 (step 1308). The method then continues with the EGM 108 and/or back-betting system 116 reporting the back-betting activity for the EGM 108 based on the determined reporting levels (step 1312). In some embodiments, the reporting may vary or be adjusted for the primary gambling player and/or for the back-betting player(s). For instance, reporting of back-betting information to other back-betting players may be controlled based on the determined reporting levels. Alternatively or additionally, reporting of back-betting information to the primary gambling player may be controlled based on the determined reporting levels.

Figure 14:
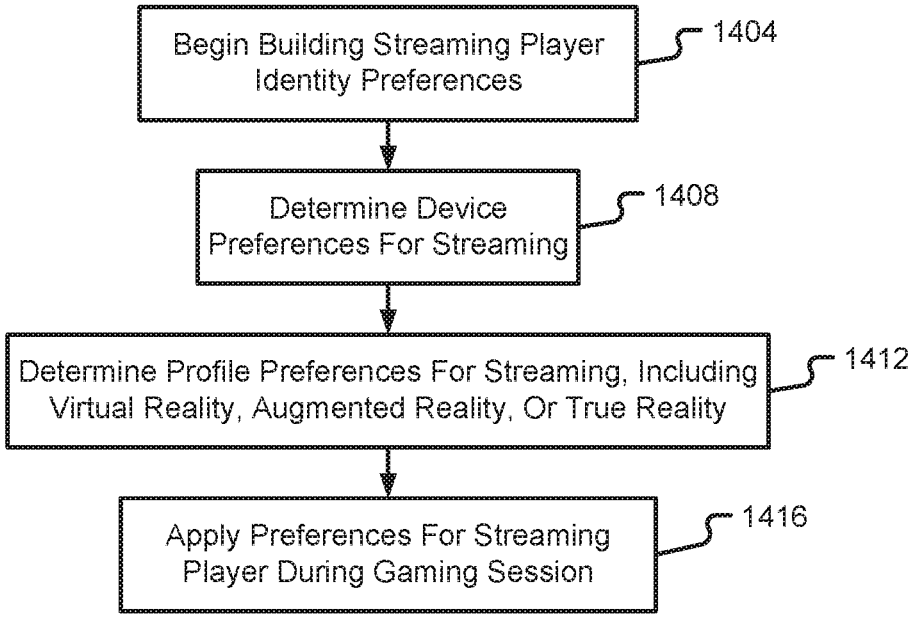
FIG. 14 is a flow diagram depicting another back-betting method in accordance with embodiments of the present disclosure.

With reference now to FIG. 14, additional details of another back-betting method will be described in accordance with at least some embodiments of the present disclosure. The method begins by enabling a primary gambling player 204 to build a streaming player identity. Part of building a streaming player identity may involve allowing the primary gambling player 204 to define their own streaming preferences for streaming and preferences specific to sharing an identity of the primary gambling player 204 (step 1404). The primary gambling player 204 may begin building their streaming player identity preferences with their own computational device 244, at an EGM 108, at a dedicated kiosk, or the like. In some embodiments, the streaming player identity preferences may be built and stored within a dedicated application operating on the player's 204 computational device 244.

The method continues by enabling the player 204 to define device preferences for streaming their gameplay sessions (step 1408). As some non-limiting examples, the primary gambling player 204 may be allowed to define what type of device will be used to capture their gameplay session information and what type of device will be used to share their gameplay session information with other back-betting players 208. In some examples, the same device that captures the gameplay session information may correspond to the same device that shares the information, but this is not necessarily a requirement. As a non-limiting example, the primary gambling player 204 may define their computational device 244 to be the device that will capture and share gameplay session information. As another non-limiting example, the primary gambling player 204 may define a preference to have an EGM 108 capture and share their gameplay session information. In some embodiments, both the computational device 244 and EGM 108 may be configured to capture gameplay session information, but only one of those devices (e.g., either the computational device 244 or the EGM 108) will be used to share the gameplay session information with other computational devices 148 via the communication network 104.

The method further continues by enabling the primary gambling player 204 to define their profile preferences for streaming, including whether to stream the gameplay information as part of a virtual reality, an augmented reality, or true reality (step 1412). For instance, the primary gambling player 204 may be allowed to view themselves and their chat sessions on their computational device 244. The primary gambling player 204 may also be allowed to blur themselves or their face to protect their true identity. Alternatively or additionally, the primary gambling player 204 may select augmented reality features or faces to include as part of streaming their gameplay session information. For instance, the primary gambling player 204 may select an augmented reality face or a different face and the images captured of the primary gambling player 204 may be analyzed for facial features and motions. Those facial features and motions may be used to modify an avatar of the primary gambling player 204 that is streamed to other back-betting players 208. In some embodiments, the primary gambling player 204 may define that they wish to share their face or true identity with back-betting players 208.

The profile preferences built by the primary gambling player 204 may then be stored in memory such that they can be used and referenced when the primary gambling player 204 streams a gameplay session to other back-betting players 208 (step 1416). In particular, the preferences for device use and what type of information to share with back-betting players 208 will be applied when the primary gambling player 204 engages in a gameplay session and starts streaming at least some of the gameplay session. It should be appreciated that the preferences defined by a primary gambling player 204 may be redefined, but may still need to comply other streaming requirements defined by a streaming service and/or by the entity managing the back-betting system 116 or wagering system 156.

Figure 15:
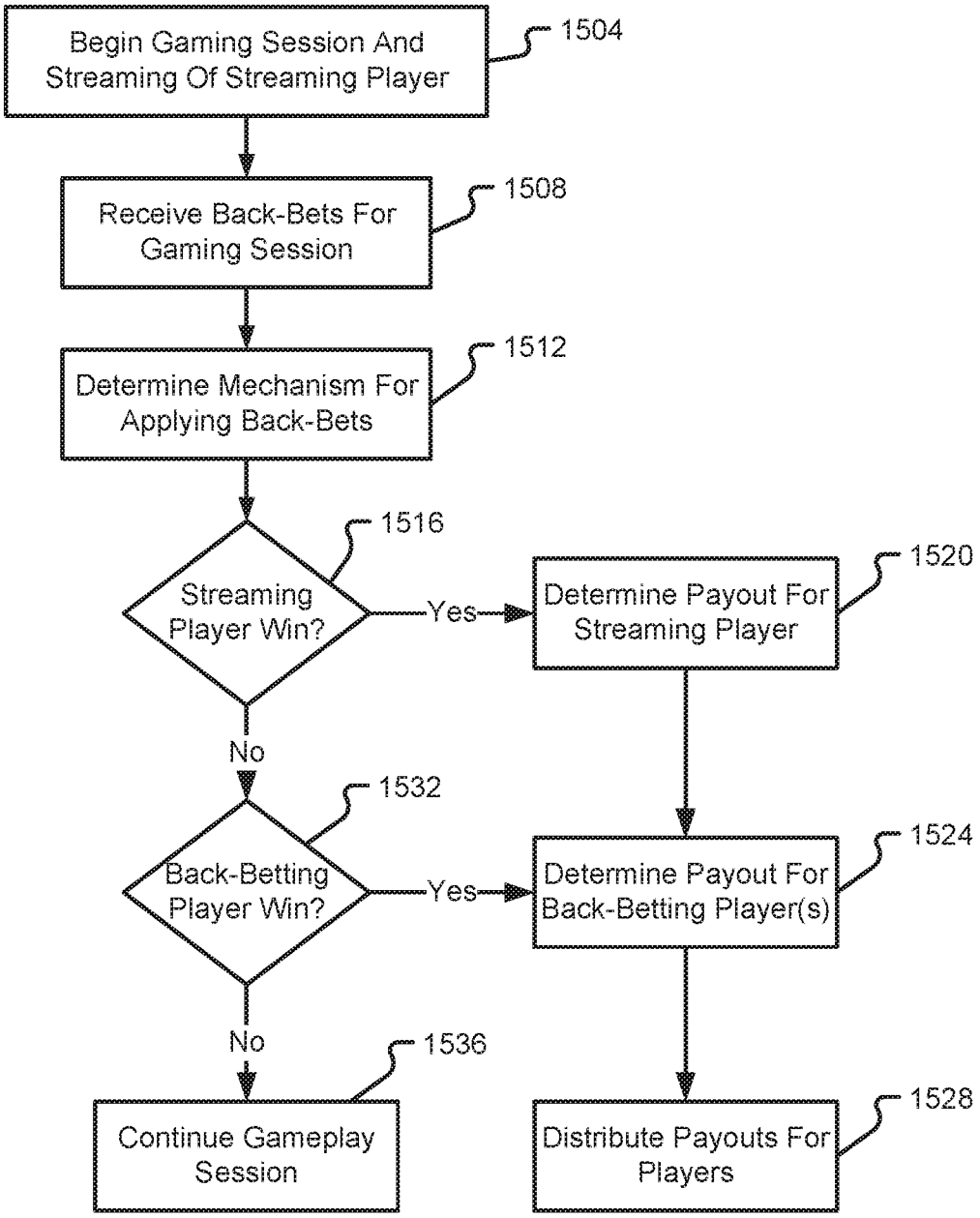
FIG. 15 is a flow diagram depicting another back-betting method in accordance with embodiments of the present disclosure.

With reference now to FIG. 15, details of another back-betting method will be described in accordance with at least some embodiments of the present disclosure. The method begins when a primary gambling player 204 starts streaming at least some portion of their gameplay session to other back-betting players 208 (step 1504). In some embodiments, the streaming of content may precede any other players actually becoming a back-betting player vis-à-vis placement of a back-bet on the primary gambling player's 204 gameplay session. The method eventually continues when one or more back-bets are received from a back-betting player 208 for the primary gambling player's 204 currently gameplay session (step 1508).

Prior to or upon receiving the back-bet, the method continues by determining the mechanism for applying the back-bet (step 1512). In some embodiments, when the primary gambling player 204 is engaged in a game at the EGM 108, a percentage of wagers placed by the primary gambling player 204 may be stored in an escargot pot or progressive pot and could be used to fund a win for a back-betting player 208. Alternatively or additionally, the back-betting player(s) 208 could be provided with advertisement content in parallel with the streaming of the primary gambling player 204 or at specified intervals during the streaming of content from the primary gambling player 204. The payments made for display of the advertisement content may be used to fund the back-bets made by the back-betting player(s) 208 and/or used to fund the game play of the primary gambling player 204. In some embodiments, back-betting player(s) 208 may be allowed to choose different criteria for purposes of back-bet wagers. Examples of such criteria include, without limitation, number of primary gambling player 204 wins within a predefined period of time, triggering a bonus within a predetermined period of time, the primary gambling player 204 exceeding a predetermined win amount within a predetermined period of time, combinations thereof, etc.

The method continues by determining whether the primary gambling player 204 (e.g., now the "streaming player") has won during their gameplay session (step 1516). The method may also include determining whether or not the back-betting player(s) 208 have won any of their back-bets placed on the primary gambling player 204 (step 1532). These two determinations may be dependent upon one another (e.g., the back-betting player 208 may not be able to win unless the primary gambling player 204 experiences a win). Alternatively, a back-betting player 208 may be able to win a back-bet wager even if the primary gambling player 204 doesn't win on their wager. Thus, steps 1516 and 1532 may be performed in a different order than depicted, may be performed concurrently, or may be performed with some other steps provided there between.

Regardless of the order in which steps 1516 and 1532 are performed, the method may further include determining a payout for the primary gambling player 204 (step 1520) and/or determining a payout for a back-betting player 208 (step 1524). The amount of payout provided to a back-betting player 208 may depend upon the mechanism used to apply the back-bets, the nature of the primary gambling player's 204 win, a number of other back-betting players 208 that won, etc. The determined payout(s) for the primary gambling player 204 and back-betting players 208 may then be distributed to the appropriate players (step 1528). In some embodiments, the payout(s) may be distributed directly from the EGM 108, directly into a player account for the winning player, directly to a credit meter on the EGM 108, or the like.

If neither the primary gambling player 204 nor a back-betting player 208 wins, then the method may continue by allowing the gameplay session to continue and by streaming the additional content of the gameplay session (step 1536). This may continue until the primary gambling player 204 discontinues their gameplay session or until it is determined that no further back-betting is allowed for the primary gambling player's 204 gameplay session.

Figure 16:
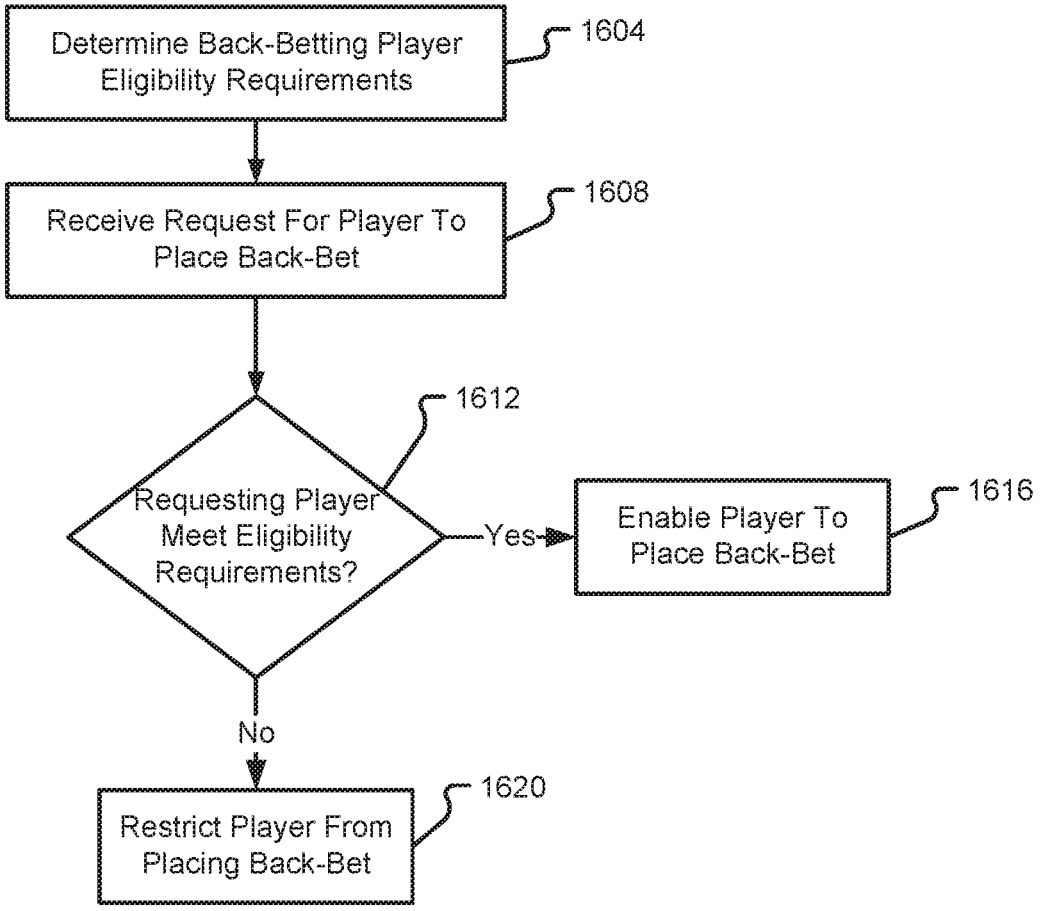
FIG. 16 is a flow diagram depicting another back-betting method in accordance with embodiments of the present disclosure.

With reference now to FIG. 16, additional details of another back-betting method will be described in accordance with at least some embodiments of the present disclosure. The method begins by determining eligibility requirements for back-betting players 208 (step 1604). In some embodiments, a player may not be allowed to become a back-betting player 208 until they have complied with all requirements for becoming a back-betting player 208.

Thus, the method will continue when a request is received from a player to place a back-bet (step 1608). In some embodiments, the request to place a back-bet may correspond to a request for a player to become a back-betting player 208. Such a request may cause the back-betting system 116 to determine whether the requesting player meets the back-betting player eligibility requirements (step 1612). In some embodiments, a person may be allowed to view video and audio content of a primary gambling player's 204 gameplay session (e.g., streaming of the session). Such persons do not necessarily have to place back-bets or become back-betting players 208. A subscriber or viewer of a streaming gameplay session may click a button (on their computational device 148) while the streamed content is being displayed, which indicates a desire to place a back-bet on the primary gambling player 204. When such an input is received, the back-betting system 116 may begin an analysis of whether or not the request can be granted based on whether or not the requestor meets the eligibility requirements. In some embodiments, a player will only be allowed to place a back-bet wager if they meet the requirements of being part of a player rewards service with a venue that can verify the requesting user is of the legal gambling age. In some embodiments, back-betting player eligibility may also be dependent upon the number of points accumulated on the player's point card or player account. Embodiments of the present disclosure also contemplate requiring the player to meet eligibility as determined by a responsible gaming system that is built into the back-betting system 116. The responsible gaming system may be configured to review the requesting player's previous gambling behaviors, money played, frequency of wagers, etc. In some embodiments, the back-betting system 116 may also limit the number of back-betting players 208 for a particular primary gambling player 204. For instance, after a primary gambling player 204 has a predetermined maximum number of back-betting players 208 placing wagers on the gameplay session, then subsequent requests for back-bet wagers may be denied, even if the request is received from an otherwise eligible player. This may result in a maximum number of back-betting players 208 for any given wager placed by the primary gambling player 204.

If the back-betting system 116 determines that the requesting player meets the eligibility requirements, then the method may continue by enabling the player to place a back-bet on the primary gambling player 204 (step 1616). On the other hand, if the requesting player is determined not to meet the requirements, then the back-betting system 116 may restrict the player from placing a back-bet (step 1620). Again, the restriction on a back-bet may depend upon the player's eligibility requirements and/or upon whether or not too many other back-betting players 208 are already placing back-bets on the primary gambling player 204.

Figure 17:
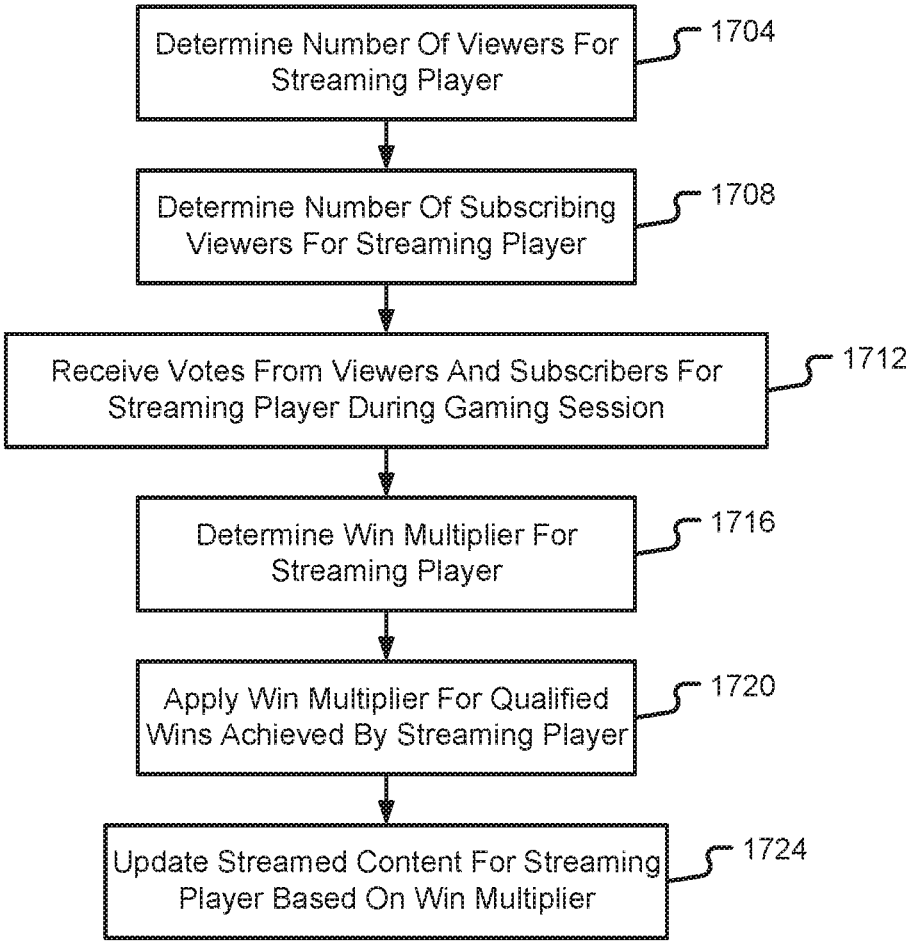
FIG. 17 is a flow diagram depicting another back-betting method in accordance with embodiments of the present disclosure.

With reference now to FIG. 17, additional details of another back-betting method will be described in accordance with at least some embodiments of the present disclosure. The method begins by determining a number of viewers for a primary gambling player 204 that is streaming a current gameplay session and, therefore, behaving as a streaming player (step 1704). The method may also include determining a number of subscribing viewers for the primary gambling player 204 (step 1708). In some embodiments, a viewer does not necessarily have to correspond to a subscriber for a primary gambling player 204. Likewise, a subscriber does not necessarily have to be currently viewing streaming content from a primary gambling player 204. Thus, the back-betting system 116 may differentiate between a current viewer of a primary gambling player's 204 gameplay stream and a subscriber of the primary gambling player's 204 gameplay stream.

In some embodiments, viewers and/or subscribers may be allowed to provide votes for the primary gambling player 204 during a gameplay session (step 1712). Votes received from viewers and/or subscribers may include votes for the primary gambling player 204 to place a certain wager at the EGM 108, votes to avoid certain wagers at the EGM 108, votes to engage in a bonus spin, votes for placing a playing a certain hand or taking a certain action during a game (e.g., take a "hit" in the game of 21, drops certain cards in poker, play a certain payline on a slot machine, etc.). The votes may impact actions taken by the primary gambling player 204 or may simply correspond to "like" or "dislike" votes. In some embodiments, votes received during the gameplay session may impact a win or win multiplier that is provided to the primary gambling player 204. Thus, the method may include determining a win multiplier for the primary gambling player 204, which may be based on votes, number of viewers, and/or number of subscribers (step 1716).

When the primary gambling player 204 wins during the gameplay session, the method may continue by applying the win multiplier to the win, assuming that the win qualifies as a win that can be multiplied by the win multiplier (step 1720). In some embodiments, only certain types of wagers or wins may be eligible for a win multiplier. For example, embodiments of the present disclosure may limit win multipliers to only max bet wagers, bonus spin wins, and/or wagers placed when there is a back-bet also placed on the primary wager.

In some embodiments, the method may also include updating the content streamed during the gameplay session for the primary gambling player based on the win multiplier (step 1724). For instance, if a win multiplier is awarded or applied in step 1720, then the streamed content may be updated to display a special icon for the primary gambling player, a special emoji icon may be displayed, or some other alteration to the presentation of content may be applied. In some embodiments, a primary gambling player 204 may be allowed predefine certain updates to apply to the streamed content if a win multiplier is applied. The primary gambling player 204 may also predefine the types of awards that a back-betting player 208 receives if a win multiplier is applied. The predefinition of back-betting player 208 awards may help the primary gambling player 204 attract more votes, viewers, and/or subscribers from back-betting players 208.

Figure 18:
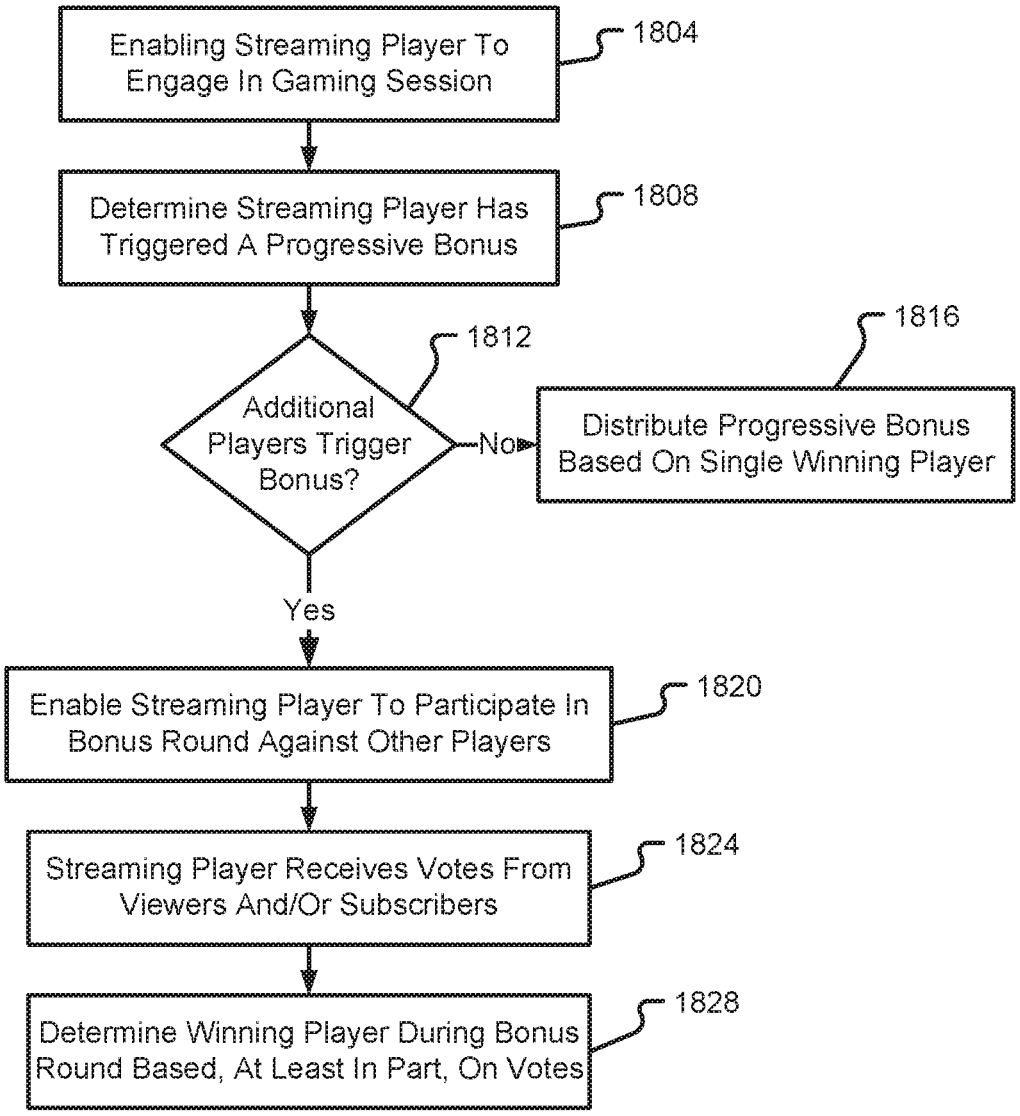
FIG. 18 is a flow diagram depicting another back-betting method in accordance with embodiments of the present disclosure.

With reference now to FIG. 18, additional details of another back-betting method will be described in accordance with at least some embodiments of the present disclosure. The method begins when a primary gambling player 204 engages in a gameplay session and streams content from that gameplay session (step 1804). As discussed herein, the content streamed during the gameplay session may include real-time audio and/or video content of the primary gambling player 204, real-time game state information, augmented or virtual reality elements that are updated based on actions of the primary gambling player 204, and the like.

The method may further continue by determining that the primary gambling player 204 has triggered a progressive bonus (step 1808). This determination may be made when the primary gambling player 204 wins a certain wager, has bet a predetermined minimum amount, has a certain number of viewers/subscribers/back-betters 208, or the like.

The method may further continue by determining if additional players, other than the primary gambling player 204, have also triggered the bonus (step 1812). If not additional players have also triggered the progressive bonus, then the progressive bonus may be distributed based on the primary gambling player 204 winning the progressive bonus as the sole winner (step 1816). In some embodiments, the distribution of funds from the progressive prize pool may be solely distributed to the primary gambling player 204, or may be at least partially shared with the back-betting players 208 that placed a back-bet on the winning primary gambling player 204.

If the query of step 1812 is answered affirmatively, then the method may continue by enabling the primary gambling player 204 to participate in a bonus round where the primary gambling player 204 competes against the other players that triggered the progressive bonus (step 1820). During the bonus round, the primary gambling player may receive votes from their viewers, subscribers, or back-betting players 208 that have placed back-bets (step 1824). For instance, a progressive prize may be built into the game played at the EGM 108 by the primary gambling player 204 that will be funded by game play at the EGM 108. The progressive may be a linked progressive either venue wide or state or multi-state wide. When a primary gambling player 204 is playing, then the viewers may participate in the progressive pool by placing back-bets on the primary gambling player 204. In some embodiments, the more viewers the primary gambling player 204 has, the larger tier progressive they are eligible to play for. When the primary gambling player 204 triggers the progressive, all the current back-betting players 208 (or possibly viewers if the progressive is partially funded by advertisement funds) will win a portion of the progressive prize. To win the progressive prize, the primary gambling player 204 may be required to first participate in the bonus round where they are pitted against other primary gambling players in a multi-player game. Viewers or back-betters of the primary gambling players 204 can, in chat, participate in the bonus round by voting to help the primary gambling player 204 they watch or back-bet on to win. Thus, the winner of the bonus round may be determined, at least in part, on the number of votes received from viewers and back-betting players 208 during the bonus round (step 1828).

While embodiments depicted and described herein have focused on back-betting on the game outcome, embodiments of the present disclosure are not so limited. Indeed, this particular application should not be construed as being limited o back-betting on a discrete game outcome. In some embodiments, a back-betting player could be allowed to back-bet on an event, a series of events, outcomes, or symbols at the EGM 108 resulting from the primary gambling player's play. This could include bets on but not limited to the following: (i) particular outcome or symbol or card; (ii) multiple losing outcomes in a row; and/or (iii) multiple winning outcomes in a row.

As should be appreciated by one skilled in the art, aspects of the present disclosure have been illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure have been described herein with reference to flowchart illustrations and/or block diagrams of methods, apparatuses (systems) and computer program products according to embodiments of the disclosure. It should be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The invention is claimed as follows:

1. A computational device, comprising:

a communication interface that facilitates machine-to-machine communications;

a user interface comprising a user input and user output;

a processor coupled with the communication and user interfaces; and a computer-readable storage medium, coupled with the processor, comprising instructions that are executable by the processor, wherein the instructions comprise:

an association instruction set that enables the computational device to be associated with and dissociated from an asset of a gaming system, wherein association with the asset of the gaming system comprises establishing a direct communication link between the computational device and the asset, wherein a back-betting player, through use of the computational device, may place a back-bet on an outcome of an event associated with the asset; and a back-betting instruction set that enables the establishment of a back-betting session between the computational device and a back-betting system conditional upon maintaining the direct communication link between the computational device and the asset, wherein the back-betting instruction set further enables an exchange of back-bet wager information with the back-betting system via a communication pathway that bypasses the asset of the gaming system and restricts a placement of back-bets with the back-betting system when the direct communication link is not established between the computational device and the asset of the gaming system.

2. The computational device of claim 1, wherein the instructions further comprise:

a wagering synchronization instruction set that accesses a clock of the computational device and determines a time when a back-bet wager is placed with respect to an event of the asset.

3. The computational device of claim 1, wherein the computational device comprises a mobile device and wherein the instructions further comprise:

a player account instruction set that stores player account information for the back-betting player and that accesses financial account information for the back-betting player.

4. The computational device of claim 1, further comprising an image capture device that captures an image of the asset, wherein the associating instructions analyze the image in connection with associating the computational device with the asset of the gaming system.

5. The computational device of claim 1, wherein the association instruction set enables the computational device to be paired with and unpaired from the asset of a gaming system, wherein the asset comprises an Electronic Gaming Machine (EGM), and wherein the direct communication link is used to exchange state-of-play information for a game played at the EGM.

6. The computational device of claim 1, wherein the communication pathway passes through a mobile network.

7. A back-betting system, comprising:

a first communication interface that facilitates machine-to-machine communications with an Electronic Gaming Machine (EGM) of a gaming system, and a back-betting server wherein the first communication interface is used to exchange state-of-play information with the EGM via a first communication pathway;

a second communication interface that facilitates machine-to-machine communications with a mobile device and the back-betting server, wherein the second communication interface is used to exchange back-bet wager information and deliver an indication of an outcome of a back-bet placed during a back-betting session established with the mobile device via a second communication pathway that is different from the first communication pathway;

a processor; and a computer-readable storage medium comprising processor-executable instructions that limit a duration of the back-betting session based on a direct wireless communication link existing between the EGM and the mobile device, wherein the direct wireless communication link is different from the first communication pathway and different from the second communication pathway.

8. The back-betting system of claim 7, wherein the back-bet placed during the back-betting session relates to an outcome of a bet made at the EGM, wherein the outcome of the bet made at the EGM is included in the state-of-play information, and wherein the back-bet placed during the back-betting session is funded by a back-betting pool that is separate from a pool of funds used in connection with the bet made at the EGM.

* * * * *